US010529190B1

(12) United States Patent
Halvorson

(10) Patent No.: US 10,529,190 B1
(45) Date of Patent: Jan. 7, 2020

(54) GAMING SYSTEM AND METHOD INCLUDING STORED SYMBOL AWARDS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/230,954

(22) Filed: Dec. 21, 2018

(51) Int. Cl.
*G07F 17/32* (2006.01)

(52) U.S. Cl.
CPC ..... *G07F 17/3267* (2013.01); *G07F 17/3213* (2013.01); *G07F 17/3258* (2013.01); *G07F 17/3262* (2013.01)

(58) Field of Classification Search
CPC ..... G07F 17/3267; G07F 17/3213; G07F 17/3258; G07F 17/3262
USPC ..... 463/20
See application file for complete search history.

(56) References Cited

U.S. PATENT DOCUMENTS

2002/0045474 A1* 4/2002 Singer ..... G07F 17/32 463/20

* cited by examiner

*Primary Examiner* — Kevin Y Kim
(74) *Attorney, Agent, or Firm* — Resolute Legal PLLC

(57) ABSTRACT

Various implementations of a gaming system and method include collecting and storing different symbols in different corresponding symbol storage areas and determining an award based one of the different symbol storage areas that collected the most number of associated symbols.

20 Claims, 10 Drawing Sheets

GAMING SYSTEM AND METHOD INCLUDING STORED SYMBOL AWARDS

FIELD OF THE DISCLOSURE

The present disclosure relates to gaming devices.

BACKGROUND

Gaming machines accept wagers from players in exchange for the opportunity to win awards or prizes. Current gaming machines use computing devices that control various technologies to provide specialized systems adapted to gain the attention of players and to keep them engaged with the gaming machines. To retain players' interest, gaming machines that offer new and unconventional functionality are needed.

SUMMARY

Various implementations of a gaming system and method include collecting and storing different symbols in different corresponding symbol storage areas and determining an award based on one of the different symbol storage areas that collected the most number of associated symbols. In some implementations, the gaming system generates selectable hidden sets of symbols in symbol display areas of a game. The gaming system reveals a set of symbols when a player selects a symbol display area associated with the set of symbols. In some implementations, the gaming system enables a player to make one or more selections of symbol display areas to reveal one or more sets of symbols. The gaming system may randomly indicate a symbol of the revealed set of symbols. The gaming system stores the indicated symbol in one of the symbol storage areas associated with the symbol. The gaming system may enable the player to make multiple rounds of selections with one or more selections per round. The gaming system may calculate a tally of stored indicated symbols and determine an award based one of the different symbol storage areas that accumulated the most number of associated symbols. In some implementations, the award is a progressive award. In some implementations, the different symbol storage areas are associated with different progressive awards.

In some implementations, the gaming system includes symbol display areas associated with video-based slot machine reels (also herein referred to as "reels"). For example, the gaming system may include five reels, where a reel is associated with symbol display areas. The gaming system may further include symbol sets that provide symbols associated with different reels. Further, the gaming machine may include pay lines corresponding to various combinations of symbol display areas. A player may selectively activate one or more of the pay lines by placing wagers on such pay lines. For example, selecting a minimum wager amount may activate only one pay line, selecting additional wager amounts may activate additional pay lines, and selecting a maximum wager amount may activate all pay lines.

For a play of a game, the gaming system may generate symbols from symbol sets associated with the reels, for the symbol display areas of the reels. The gaming system may evaluate the displayed symbols to identify winning symbol combinations and determine a payout amount based on the winning symbol combinations along wagered pay lines.

In some implementations, the gaming system may also determine if a bonus game should be triggered. In some implementations, the gaming system determines whether a bonus controller outputs a bonus game triggering signal. In some implementations, the bonus controller randomly generates a bonus game triggering signal. In some implementations, the bonus controller outputs a bonus game triggering signal based on one or more different statistics, such as how much a player has wagered, how long the player has played games on the gaming system, etc. In alternative implementations, the gaming system may evaluate the displayed symbols for symbol combinations that trigger a bonus game. In some implementations, at least one symbol from the symbol sets are designated as a triggering symbol. When the gaming system determines that a predetermined quantity of triggering symbols are generated, the gaming system may activate a bonus game.

Upon a bonus triggering event, the gaming system may execute a bonus game. In some implementations of the bonus game, the gaming system generates hidden sets of symbols in selectable symbol display areas of a game. The gaming system reveals a hidden set of the symbols when a player selects a symbol display area associated with the hidden set of symbols, creating a visible set of symbols. In some implementations, the gaming system enables a player to make one or more selections of symbol display areas to reveal one or more hidden sets of symbols. The gaming system may randomly indicate a symbol of a revealed set of symbols. The gaming system stores the indicated symbol in one of the symbol storage areas associated with the symbol. The gaming system may enable the player to make multiple rounds of selections of symbol display areas with one or more selections per round. The gaming system may calculate a tally of stored indicated symbols and determine an award based on one of the different symbol storage areas that accumulated the most number of associated symbols among the other symbol storage areas. In some implementations, the award is a progressive award. In some implementations, the different symbol storage areas are associated with different progressive awards.

As described above and set forth in greater detail below, gaming systems in accordance with aspects of the present disclosure provide a specialized computing device including non-conventional hardware and software that improve upon the existing technology of human-computer interfaces by providing functionality of generating display outputs that enable players to collect symbols and generate new awards. Doing so improves the operation of the gaming systems for their specialized purpose by reducing player disappointment with game outcomes and enhancing player excitement for a game.

DETAILED DESCRIPTION

Figure 1:
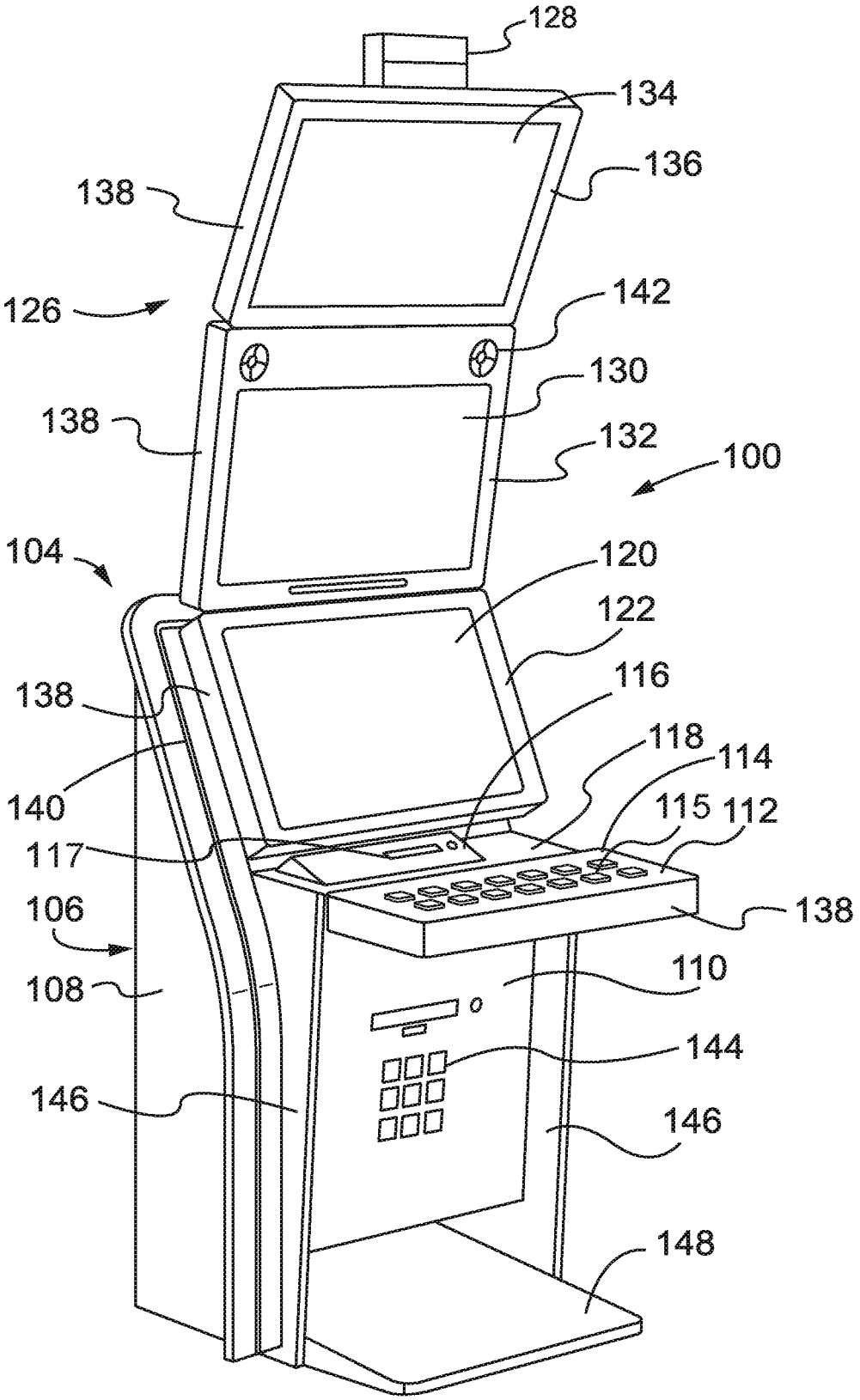
FIG. 1 shows a perspective view illustrating an example gaming device in accordance with aspects of the present disclosure.

Various implementations of a gaming system and method include collecting and storing different symbols in different corresponding symbol storage areas and determining an award based one of the different symbol storage areas that collected the most number of associated symbols. In some implementations, the gaming system generates selectable hidden sets of symbols in symbol display areas of a game. The gaming system reveals a hidden set of symbols when a player selects a symbol display area associated with the hidden set of symbols. In some implementations, the gaming system enables a player to make one or more selections of symbol display areas to reveal one or more hidden sets of symbols. The gaming system may randomly indicate a symbol of the revealed set of symbols. The gaming system stores the indicated symbol in one of the symbol storage areas associated with the symbol. The gaming system may enable the player to make multiple rounds of selections with one or more selections per round. The gaming system may calculate a tally of stored indicated symbols and determine an award based one of the different symbol storage areas that accumulated the most number of associated symbols. In some implementations, the award is a progressive award. In some implementations, the different symbol storage areas are associated with different progressive awards.

In some implementations, a gaming system includes a cabinet, a processor, a display device supported by the cabinet, an input device supported by the cabinet, a value acceptor supported by the cabinet, a value dispenser supported by the cabinet, and a memory device that stores program instructions. The program instructions, when executed by the processor, control the gaming device to perform operations including establishing a credit balance based at least in part on a monetary value received by the value acceptor. The operations can also include placing a wager following receipt of a wager input via an input device and decreasing the credit balance by the wager. The operations can also include randomly generating a plurality of wheels in a plurality of symbol display areas, wherein the plurality of wheels comprise a plurality of symbols, and wherein the plurality of wheels are hidden in the plurality of symbol display areas. The operations can include receiving, via the input device, a selection of a symbol display area of the plurality of symbol display areas and revealing a wheel hidden in the selected symbol display area. The operations can include randomly indicating one symbol of the plurality of symbols on the revealed wheel and store the indicated symbol in a symbol storage area associated with the indicated symbol. The operations can include determining a quantity of remaining selection rounds of symbol display areas and determining an award associated with a quantity of stored indicated symbols in the symbol storage area when the quantity of remaining selection rounds is a predetermined quantity (e.g., a quantity of zero). The operations can include displaying, on the display device, the determined award associated with the quantity of stored indicated symbols. The operations can further include increasing the credit balance by the determined award and issuing value from the value dispenser based on the credit balance upon receipt of a cash out request or signal via the input device.

Gaming Device Platform

The features and advantages of the gaming system and method described herein may be provided to a player via a gaming device platform that includes various structures and components for allowing player interaction with the gaming device. While only one gaming device platform will be described in detail herein, it is understood that the features, objects, and advantages of the gaming system described herein may be implemented in one or more alternative gaming device platforms.

FIG. 1 shows a perspective view illustrating an example of gaming system 100 in accordance with aspects of the present disclosure. Such gaming system 100 may be referred to as a slot machine and, as illustrated, is housed in a cabinet 104 (e.g., a housing) constructed so that a player can operate and play the gaming system 100 while standing or sitting. The cabinet 104 can include a lower cabinet body portion 106, which includes a pair of cabinet side panels 108 (only one of which is viewable in the perspective view of FIG. 1), a front panel 110, and a rear panel (not shown). Additionally, a base panel (not shown) and a top panel surface (not shown) may support a first game display device 120 and the player interaction area 112. The cabinet panels 104, 106, 108, 110 (as well as the base panel and the top panel surface) may be interconnected along their edges and cooperate to form the cabinet 104, which encloses and houses components of the gaming system 100, as can be seen in FIG. 1. The cabinet 104 may function to securely protect local control system, technology components, and provide support for game display(s) and player input and output interactions with the gaming system 100, such as describe herein below.

While the example cabinet 104 is depicted as having a particular shape, structure, and organization, it should be appreciated that a wide variety of cabinet enclosure sizes, shapes, and designs are possible for the gaming system 100. For example, the cabinet panels 104, 106, 108, 110 (as well as the base panel and the top panel surface) may be combined into fewer elements or divided into additional elements. Additionally, the positions of the displays (e.g., first display device 120) and input/output devices can be reorganized and/or relocated with respect to one another.

In accordance with aspects of the present disclosure, a player can interact with the gaming system 100 in various ways to direct the wagering and game play activities and preferences. More specifically, the cabinet 104 includes input and output areas generally designated as the player interaction area 112. The player interaction area 112 may be located on the front top side of cabinet 104 and, as shown, on a panel structure that extends outwardly from the gaming system 100 in a player's direction. The player interaction area 112 may contain player input and output structures, including a player control area 114, a player value acceptor and dispenser area 116, and player convenience input area 118.

The player control area 114 includes one or more input devices 115, such as buttons and touch sensitive areas, through with which players may interact with the gaming system 100 so as to direct game play. It is expected that the cabinet 104 provides an easily accessible location and support for player input/output (I/O) interactions with the gaming system 100, including gaming control interactions and value wagering interactions. Although the gaming system 100 illustrated in FIG. 1 shows the input devices 115 of the player control area 114 as physical controls (e.g., buttons), it is understood that in some implementations, a player's gaming control interactions could be made by either the physical controls or functionally equivalent "soft" controls (e.g., soft buttons) located on the gaming display and activated by player touch (e.g., touch screen interfaces), or a combination of both arrangements.

The input devices 115 may include the following: game selection button(s) in any implementation where more than one game is provided in a single gaming system 100; gaming denomination value selection button(s) in any implementations where one or more wagering denomination value is accommodated; wager selection button(s) for the player to indicate or select the desired wager value for a game in any implementations where a selection of wager values are offered; pay line selection button(s) for selecting the number of active pay lines in game implementations that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information.

The player value acceptor and dispenser area 116 may include one or more value acceptance and value distribution devices 117 that allow the player to interact with the gaming system 100 and to risk or otherwise place a wager (a monetary value) on one or more outcomes of a game. The value acceptance and value distribution devices 117 may return winnings to the player via some form of value distribution. In the player value acceptor and dispenser area 116, a player can supply monetary value to the gaming system 100 via the value acceptance and value distribution devices 117. In some implementations, the value acceptance and value distribution devices 117 may accept any one or more of the following from a player to establish a gaming credit balance: coins, bills, tokens, tickets/vouchers, player ID cards, credit cards, or other suitable forms of value. Thus, if the gaming system 100 accepts coins and bill, the value acceptance and value distribution devices 117 may comprise a currency bill validator and a coin validator. Likewise, if the gaming system 100 accepts tickets, the value acceptance and value distribution devices 117 may comprise a ticket acceptor that receives tickets or vouchers representing some monetary value. The ticket acceptor may include a bar code reader, or other appropriate code reader, for reading the encoded value contained by the player's ticket or voucher. In some implementations, value acceptance and value distribution devices 117 can accept more than one type of value. In some implementations, the player value acceptor and dispenser area 116 may include multiple different value acceptance and value distribution devices 117 that accept different types of value from players.

Upon receipt of some type of value from the player, the value acceptance and value distribution devices 117 of the player value acceptor and dispenser area 116 can perform validation on the player supplied value using appropriate hardware readers (e.g., determining that the currency bills/coins/tokens are genuine or the ticket/voucher is genuine). If the validation result is positive on player supplied value, the value acceptance and value distribution devices 117 can generate a signal to a processor of the gaming system 100 that establishes a gaming credit balance for playing one or more games on gaming system 100.

In some implementations, the value acceptance and value distribution devices 117 dispenses a monetary value, or a representation thereof, from the gaming system 100 when a player chooses to "cash out" the gaming credit balance (e.g., remove value from the gaming system 100). The player can cash out at any suitable time. When a player cashes out the value contained on a credit meter (not shown) of gaming system 100, a processor of gaming system 100 may cause a printer included in the value acceptance and value distribution devices 117 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming system 100 may cause a currency bill dispenser or a coin dispenser included in the value acceptance and value distribution devices 117 to dispense the value contained on the credit meter of gaming system 100.

Various combinations of the above value acceptance and value distribution arrangements are possible. The gaming system 100 may include other value acceptance and value distribution mechanisms in the player value acceptor and dispenser area 116. For example, the value acceptance and value distribution devices 117 may include a magnetic strip or chip card reader/writer in order to accept value from and transfer value to a magnetic strip or an embedded chip card. In other implementations, the value acceptance and value distribution devices 117 may include hardware for transferring (and receiving) non-traditional currencies to players such as digital currencies (e.g., bitcoin).

In some implementations, the value acceptance and value distribution devices 117 may include a card reader that accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming system 100 may be associated with the player account. Additionally, a numeric or alphanumeric keypad (not shown) may be provided adjacent to the card reader slot that enables player entry of a personal identification number or the like for secure access to card information.

In some implementations, a player convenience input area 118 may be included in the gaming system 100, as is shown in FIG. 1. In various implementations, player convenience input area 118 may have a variety of features and functions depending on the jurisdictional deployment of the gaming system 100. In some implementations, the player convenience input area 118 may house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into the gaming system 100 during play. These player loyalty/player tracking cards may be associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain implementations, the player convenience input area 118 may include player convenience features such as a pocket for storage that allows players to store their personal items such as a mobile phone. The gaming system 100 may include one or more universal serial bus (USB) ports that enables a player to charge their electronics or connect to services such as the Internet or food service. Further, player convenience input area 118 of the gaming system 100 may include buttons to request food or drink service if the gaming device is located in an establishment that has food and drink service. The gaming system 100 may be connected to a local or wide area network such that selection of the requested food or drink service may alert the establishment's hospitality staff to deliver the requested service directly to the gaming system 100.

The layout of the player control area 114, player value acceptor and dispenser area 116, and the player convenience input area 118 in gaming system 100 may be arranged differently than those disclosed and illustrated herein. The selections and arrangement of input locations on the cabinet 104 may be dependent upon the game buttons, the type of value wagered, and the player conveniences utilized in the deployment configuration of gaming system 100.

With continuing reference to FIG. 1, in some implementations, the lower cabinet body portion 106 includes the first game display device 120, which can be mounted atop or flush with a top panel surface of the lower cabinet body portion 106. The first game display device 120 can be, for example, a 27-inch liquid crystal display (LCD) display mounted in a widescreen orientation. However, any suitable display may be used in any suitable orientation. In the illustrated implementation, the first game display device 120 can mounted within and framed by first display frame 122 which is, in turn, mounted upon lower cabinet body portion's top panel surface. In this manner, the first game display device 120 is both surrounded and secured within the first display frame 122 and raised above the cabinet's top panel surface. Additional features of the first display frame 122 are described below. In some implementations, the gaming system 100 may use a single first game display device 120 and not include additional game displays (not illustrated). For example, a single first game display 120 may span the one or more portions of the cabinet 104 (e.g., lower body cabinet portion 106 and upper body cabinet body portion 126, described below) in place of other display devices (e.g., display devices 130 and 134, described below).

The lower cabinet body portion 106 can be further constructed to support an upper cabinet portion 126. The upper cabinet portion 126 may be comprised of an upwardly extending support structure (not illustrated) that extends upwardly from the rear side of lower cabinet body portion 106 configured to mechanically support one or more additional game displays.

At the topmost end of the support structure, a cabinet top light 128 may be provided. The cabinet top light 128 is capable of illumination in a variety of colors and is utilized to indicate and communicate conditions of the gaming system 100 to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In some implementations, as illustrated in FIG. 1, gaming system 100 includes additional displays, including a second game display device 130 and a third game display device 134. The second game display device 130 and the third game display device 134 can be disposed generally in a vertical relationship and generally in alignment with the first game display device 120. Like the first game display device 120, the second game display device 130 and the third game display device 134 can be 27-inch LCD displays and can be mounted in a widescreen orientation in some implementations. However, any suitable display in any suitable orientation may be used for the second game display device 130 and the third game display device 134. Further, like the first game display device 120, the second game display device 130 and the third game display device 134 can be mounted within and framed by second display frame 132 and third display frame 136, respectively. The second display frame 132 and the third display frame 136 can be attached to the upper cabinet support structure and can protect the second game display device 130 and the third game display device 134.

The first game display device 120, the second game display device 130, and the third game display device 134 can be disposed at an angle from each other to form a player-facing concave arc. However, in some implementations, the angles between the displays 120, 130, and 134 may be adjustable and may be smaller or greater than the angles illustrated in FIG. 1. Further, it is understood that in some implementations the displays may be disposed in a common plane relative to each other.

It also should be appreciated that in various implementations a variety of display technologies may be utilized equivalently and interchangeably with a variety of implementations of the gaming device. Equivalent display devices include all variations of liquid crystal displays, light emitting diode displays, and plasma displays.

In some implementations, different sized displays may be combined to display gaming data on gaming system 100. As a non-limiting example, a 27-inch widescreen LCD display may be combined with a 20-inch portrait-oriented LCD or a light emitting diode (LED) display. This combination may be used, for example, with a third scrolling banner LED display. In alternative implementations, one, two, three, or more displays could be used in a variety of positions and orientations. Any suitable combination may be used. It should also be appreciated that a processor of gaming system 100 may communicate with the disclosed first game display device 120, second game display device 130, and third game display device 134 through a video card of gaming system 100 to produce the visible aspects of a game.

In some implementations, one or more of the first game display device 120, the second game display device 130, and the third game display device 134 may be fitted with a transparent touch sensitive overlay for sensing player touch inputs into the gaming system 100. The touch sensitive overlays can communicate with a processor of gaming system 100 to enable the player to interact with the game.

In some implementations, the curved displays may be used for any or all of the first game display device 120, the second game display device 130, or the third game display device 134. Similarly, any of the displays used for gaming system 100 can be based on flexible display technologies. For example, it is possible to utilize flexible display technologies to create uniquely shaped curving, wavy, or tubular display structures to provide one or more of the first game display device 120, the second game display device 130, and the third game display device 134. Additionally, in some implementations flexible display technologies can be used in combination with fixed flat screen technologies.

While the gaming system 100 has been described as implemented with video technologies, in some implementations, mechanical reels with reel strips containing game indicia and step motor controllers may be employed to provide game information to a player. In some implementations, the reel strips may include printed symbols. In another implementation, the mechanical reels may include flexible video display technology as the reel strips on mechanical reels. Thus, games implemented in video form can readily be implemented with mechanical reels utilizing such display technology. Alternatively, in other implementations mechanical reels with reels strips having fixed symbols displayed along the reel strip could be used to implement the game.

Dependent upon the particular gaming device housing style, a variety of other display technologies may be utilized in combination with the gaming device disclosed herein. For example, the gaming system 100 may have one or more display devices in addition to the main game display(s) in some implementations. For example, the gaming system 100 may include a player tracking device having a player tracking display which displays various information to the player regarding the player's status. The gaming system 100 may also include other game-related displays such as the wager display and the gaming credit balance display. These additional game-related displays may be separate display devices or may be displayed on any one or more of the first game display device 120, the second game display device 130, or the third game display device 134.

The gaming system 100 may also include cabinet lighting design functions to attract players. In the example gaming system 100 illustrated in FIG. 1, attractive cabinet lighting is provided by frame accent lighting 138. It is noted that frame accent lighting 138 is a common structure found on the first display frame 122, the second display frame 132, and the third display frame 136 and player interaction area 112. Example areas where frame accent lighting is applied to the gaming system 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In some implementations, the circuit boards are flexible circuit boards. These LED strips and transparent or translucent coverings may surround one or more gaming device displays frames, as well as the player interaction area, to highlight these areas.

In some implementations, the individual LEDs mounted on the LED strips are of a type that can emit red, green, and blue light. In an alternative implementation, separate LEDs are used for the light colors. All LED strips can be electrically connected and can be controlled by a cabinet lighting controller (e.g., cabinet lighting controller 218 in FIG. 2) in conjunction with a processor of the gaming system 100 to selectively mix the emitted light colors in a manner to create any color. The cabinet lighting controller can flash and vary lighting as desired. For example, cabinet edge lighting can change and flash in combination with music rhythms or in combination with game events. Other variations are possible.

In some implementations, cabinet 104 may include LED strip lighting or LED rope lighting to accentuate the cabinet and enhance the attractiveness of the gaming system 100 to players. LED rope lighting is a number of small light-emitting diode bulbs linked together and encased in a plastic, polyvinylchloride, or other suitable material to create a string of lights. For example, in one implementation illustrated in FIG. 1, cabinet 104 includes cabinet accent lighting 140. In some implementations, cabinet accent lighting 140 is LED rope lighting mounted flush with the front side edge of the cabinet side panels 108. The LED rope lighting can generate any of suitable colors, and are controlled by cabinet lighting controller and a processor of gaming system 100 to selectively mix the emitted light colors in a manner to create any color in the same manner as the frame edge lighting.

In various implementations, gaming system 100 includes one or more audio speakers 142 and appropriate driving electronics and sound cards so that game players may experience pleasing audio aspects of the gaming system 100. Audio is desirable to attract and maintain player interest in gaming system 100. The gaming system 100 may also emit attraction sounds during any idle period of gaming system 100. Game audio may add to the player's enjoyment of gaming system 100 by providing music and sound effects designed to enhance and compliment the gaming experience. In FIG. 1, the audio speakers 142 are shown mounted on the upper corners of second display frame 132. Any suitable number of additional speakers 142 may be provided on additional display frames or on the lower cabinet body portion 106 as desired.

The speakers 142 designed for emitting bass vibrations may be included in some implementations. Placement of the speakers 142 may be selected to enhance the sound emitting characteristics of the gaming system 100. For example, bass speakers or additional speakers 144 may be mounted inside lower cabinet body portion 106. Further, it is envisioned that in some implementations sound processing such as multi-channel processing and surround sound processing are included in gaming system 100. Audio jacks for attachment of player headphones may also be provided in some implementations of gaming system 100 for the player to further enhance the audio experience of the game and also to block out noise from other gaming devices.

In some implementations, the front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing the gaming system 100 in a seated position. Foot rest 148, which may be cushioned, is provided below player interaction area 112 to enhance a player's ergonomic comfort while playing the gaming system 100. In some implementations, the edges of player interaction area 112 may be ergonomically cushioned as well.

The gaming system 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary, and/or 3) provide an easy location and support for all necessary player input/output (I/O) interactions, including gaming control interactions and value wagering interactions. For example, in some implementations the gaming system 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In some implementations, housing styles of cabinet 104 of gaming system 100 may include bar top or table top housing arrangements. These housings are generally small enough to be placed on top of an existing bar or table while providing the requisite gaming device housing functions of protection of/access to gaming electronics, displays, and player I/O functions described above.

In some implementations, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
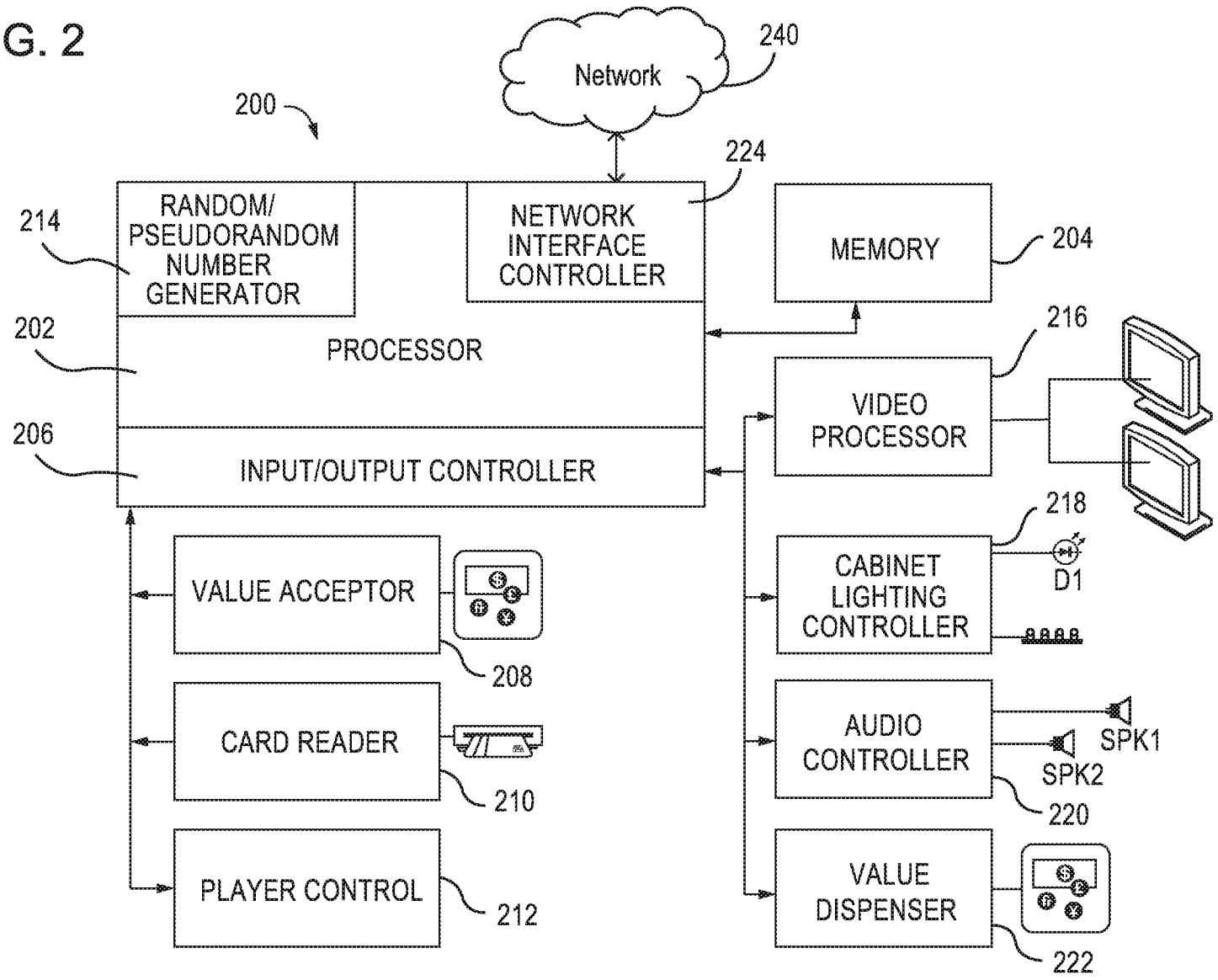
FIG. 2 shows a functional block diagram illustrating a gaming system in accordance with aspects of the present disclosure.

FIG. 2 illustrates a functional block diagram of a control unit 200 of a gaming system (e.g., gaming system 100) configured to perform specialized game functions and operations, consistent with the embodiments described herein. The functional elements shown in FIG. 2 cooperate, on a broad and general level, to function as a gaming system. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In accordance with aspects of the present disclosure, the control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one implementation, the control unit 200 is also configured to communicate with a server device through a network.

In some implementations, the control unit 200 includes at least one processor 202 (e.g., a central processing unit (CPU)). In some implementations, the processor 202 is specially configured with arithmetic logic units and math co-processors, also known as floating point units, for performing the gaming consistent with the various implementations disclosed herein. In some implementations, the specially configured processor 202 includes registers for holding instructions or other data, and cache memory for storing data for faster operation thereupon. In some implementations, the specially configured processor 202 may be a multi-core processor that includes two or more processors for enhanced performance, more efficient parallel processing, or other advantageous computing functions. In another implementation, the specially configured processor 202 may be one or more processing devices such as microprocessor (s) or integrated circuit(s) and may include one or more controllers. It should be appreciated that in some implementations, a general-purpose processor could be programmed to perform the functions of the specially configured processor 202.

A controller, in some implementations, is a device or a software program that manages or directs the flow of data between two entities. Often, controllers are special purpose circuitry or software that solve a technical communications problem between different technology systems. In some implementations, a controller functions as an interface between two systems while managing the communications between the systems. In another implementation, a controller functions as an interface between a processor and a peripheral device and functions to control the peripheral device.

At least one specially configured processor 202 or controller of control unit 200 may be specially configured to communicate with at least one memory device 204, generally shown as memory device 204 in FIG. 2. In some implementations, the memory device 204 includes one or more memory structures for storing instructions and various types of game data. The memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in some implementations, communication with the memory device 204 by the specially configured processor 202 or a controller, encompasses the processor or controller accessing the memory device 204, exchanging data with the memory device 204, or storing data to the memory device 204.

The memory device 204 may store all program code and game code (collectively the "code"), and operation data necessary for the operation of the control unit 200 providing a gaming device and execution of the gaming features described hereinbelow. In an alternative implementation, game code and operation data necessary for the operation of the control unit 200 may be stored in a distributed manner such that some code is stored in memory device 204 and other code is stored remotely from the control unit 200. In some implementations, the code and operation data necessary for the operation of the control unit 200 includes, for example, basic input and output function data, instruction fetching data, bus and network communication protocol data, and like data necessary for an operational gaming device. In some implementations, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in some implementations, the code and operation data for the operation of the gaming device described above may be stored in removable game cartridges or flash drives, a compact disk ROM, a digital versatile disk (DVD) optical storage technology, or suitable other fixed non-transitory storage mediums. In another implementation, part or all of the code and operational data for operation of the gaming device or for execution of the game features may be stored in a remote memory structure and be downloaded to the memory device 204 via a network connection.

In some implementations, the control unit 200 may utilize any combination of memory devices such as random access memory devices (RAMs), unalterable memory devices (ROMs), and mass storage devices for securely storing and securely communicating the software components or code that facilitate game play and other functions of the control unit 200. The memory devices may store software components or code that include various game data and game related control and execution software. In some implementations, the software components stored in the memory devices 204 may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the control unit 200.

In some implementations, memory devices, such as memory device 204, with the software components and other data may be secured and authenticated by authentication software stored in an unalterable memory device within the housing of the control unit 200. The control unit 200 may also include application specific integrated circuits (ASICs) to perform the security and authentication functions. At any appropriate time, such as before each play of a game, at a predetermined interval, upon transfer of any game data or any software components from a mass storage to the memory device 204, or upon demand, the control unit 200 (using a processor such as processor 202 or a separate ASIC) may execute an authentication routine and perform an authentication of any software component or other data of the control unit 200. In some implementations, the gaming device software components may be prepared for authentication via creation and storage of an encrypted signature unique to one or more of the software components.

In some implementations, an encrypted signature may be created by utilizing a hash function on a software component or code to form a message digest (i.e., a hash of the software component) followed by a key encryption of the message digest to form an encrypted signature unique to the software component. In some implementations, the key encryption may be public key encryption, private key encryption, or any suitable key encryption schema. The encrypted signature may be stored with the gaming device software component, for example, in a mass storage device or an unalterable memory. During a software component authentication, the gaming system 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and the control unit 200 may allow game play to proceed. However, when the message digests do not match, the control unit 200 may determine that the software component under authentication may be corrupted or fraudulent and game play may be halted. It should be appreciated that the control unit 200 may perform other suitable security and authentication checks on the game data or software components. Such authentication and security devices and functions are unique to gaming and casino industry to minimize or prevent fraud in gaming devices and gaming systems.

For a player to interact with a gaming device, the control unit 200 receives and processes player inputs, and the control unit 200 causes processed results to be output or communicated to the player. In some implementations, player inputs are recognized and processed or directed for processing by input/output (I/O) controller 206. Further, I/O controller 206 may process and direct player outputs for communication to the player. The I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for the attached input devices and output devices. In this manner, specially configured processor 202 is freed from the operational details of the peripheral I/O devices. For example, in some implementations where an input or output device is changed or upgraded, the I/O controller 206 can be changed without changing other gaming system components.

In some implementations, a player deposits value into a gaming device by inserting some form of currency into a value acceptor 208 for game play. Alternatively, a player deposits value into a gaming device by inserting an encoded paper ticket into a value acceptor 208 for game play in some implementations. The value acceptor 208 can be combined with a currency reader and validator, and a code reader for reading value encoded on paper tickets. The value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming system 100. During game play, the specially configured processor 202 processes a player's wagers and determines the amount of credits to debit from the player's credit balance. When a winning outcome is obtained, the specially configured processor 202 is configured to determine the amount of credits to add to the player's credit balance.

As previously mentioned with respect to FIG. 1, a variety of value acceptance arrangements are possible. In some implementations, the value acceptor 208 could include magnetic strip or chip card readers to accept and transfer value. The value acceptor 208 may also be configured to accept and transfer non-traditional currencies such as digital currencies. In these implementations, I/O controller 206, a specially configured processor 202, or both contain appropriate control instructions to communicate and extract value from the inserted item containing value. In some implementations, use of a magnetic strip or embedded chip card, for example a bank card, for value insertion requires the specially configured processor 202 to communicate, via network interface controller 224 (described below), with devices external to a gaming device.

In some implementations, a card reader 210 may be included in gaming system 100 to accept player loyalty cards. For example, card reader 210 can extract account identifying information from the card and utilizes this information to access the associated account information stored remotely via network interface controller 224. In implementations where player loyalty/player tracking systems are employed, a player's loyalty account and record of gaming activity can be stored in a networked storage location or database. The specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various implementations, a player control 212 receives a player's game inputs and communicates the player's game inputs to the specially configured processor 202. The player's game inputs may include, but are not limited to, wager amounts, pay line selections, game control signals, and cash-out signals. The player control 212 may generate signals based on button presses, touch screen activations, or voice control. The player-initiated signals are propagated to the specially configured processor 202 by the I/O controller 206. Further, the player-initiated signals may direct and inform execution of the game instructions stored in the memory device 204 and configured to be executed by the specially configured processor 202.

In some implementations, the specially configured processor 202 is configured to execute stored program code and instructions which generate random numbers or pseudo-random numbers. In some implementations, as illustrated in FIG. 2, a random number generator (RNG) 214 is a software module configured to be executed by the specially configured processor 202 for the generation of a true random or pseudo-random number. The code for RNG 214 may be stored in the memory device 204. The RNG 214 generates random numbers for use by the gaming software during game execution. In some implementations, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various implementations, once random symbols are selected based upon the random number generated by the RNG 214, patterns of symbols are compared to determine wagering outcomes. In an alternative implementation, gaming system 100 may include a hardware based random number generator that is in communication with specially configured processor 202 to supply random numbers for game generation purposes. The hardware based random number generator may be incorporated into specially configured processor 202 or can be separate from specially configured processor 202.

In yet another implementation, the random generation of "numbers" or symbols may be performed with electro-mechanical components. For example, gaming devices such as gaming system 100 may incorporate a mechanical reels rotatable about a common axis. Indicia or symbols may be positioned around the periphery of the reels. The indicia or symbols on the reels may indicate separate detectable reel stop positions. The reels can be set into a spinning/rotation motion by pulling a lever or pushing a button. In some implementations, the gaming system 100 can stop the reels by a gaming device actuating, on a random timing basis, a suitable mechanical or electro-mechanical reel brake. When the reels stop rotating, one or more displayed stop positions of the reels are detected. Since the stop positions are associated with respective indicia or symbols, the gaming device can determine whether the combination of stop positions (i.e., translating to a combination of displayed symbols) results in a winning symbol combination.

Returning to FIG. 2, the control unit 200 controls the function and output of a output devices utilized by a gaming device. In various implementations, I/O controller 206 serves as an interface unit between specially configured processor 202 and output devices such as video processor 216, cabinet lighting controller 218, audio controller 220, and value dispenser 222.

In some implementations, the video processor 216 communicates with specially configured processor 202 to render all game graphics, video displays, and information on one or more video display units (e.g., displays 120, 130, and 134). In some implementations, the video processor 216 includes one or more processors, controllers, and/or graphics cards for processing the game images, outcomes, and animated displays and coordinating the processed data to be display between, among, or across any or all display devices. In various implementations, this may include being configured to simulate objects and the movement of objects which represent video reels containing sets of gaming symbols.

It should be appreciated that in certain other implementations where physical mechanical reels are utilized by the gaming system 100 as a game displays, reel controllers and stepper motors would be provided in lieu of or in addition to video processor 216.

In implementations which utilize cabinet lighting as described with respect to FIG. 1, a cabinet lighting controller 218 may be utilized to coordinate and control the color and timing of cabinet lighting displays with specially configured processor 202. In certain implementations which utilize sound design, specially configured processor 202 may utilize audio controller 220 to coordinate and control the sound emissions. In some implementations, audio controller 220 may include one or more audio processing cards for generating sound and for driving the one, two or more speakers that may be included with a gaming device.

In various implementations, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In some implementations, value dispenser 222 can be controlled to issue the player's credit value using any of the types of value discussed herein. In some implementations, the player's credit value may be issued to the player via a printed and dispensed encoded paper ticket or token which the player can then exchange at a special purpose kiosk or cashier location for the monetary value encoded into the ticket or token. In some implementations, the specially configured processor 202 can direct the value dispenser 222 to issue to the player an appropriate amount of coin or bills directly to the player. Additionally, or alternatively, in some implementations, the player may have the option to electronically direct the credit value to an account associated with the player.

In some implementations, the control unit 200 may communicate with one or more devices outside the gaming device. For example, gaming system 100 may be connected to a larger network 240 via a local area network (LAN) or a wide area network (WAN). The control unit 200 may communicate with one or more central servers, controllers, or remote devices to execute games, establish credit balances, participate in jackpots, etc. In such implementations, network communications and connections are accomplished via a network interface controller 224. Network interface controller 224 can be a digital circuit board or card installed in control unit 200 to provide network communications with external devices.

In some implementations, various additional features and functions are performed by the control unit 200. For example, the control unit 200 may be specially configured with appropriate software to track all game play events that occur on a gaming device. In some implementations, the control unit 200 may audit all recorded monetary transactions, including all wager amounts, game outcomes, game winnings, and game payouts that occur through the value dispenser 222. Further, some implementations may include security software to assist in protecting the gaming system 100 from tamper or alteration attempts.

Gaming System Operation

Figure 3A:
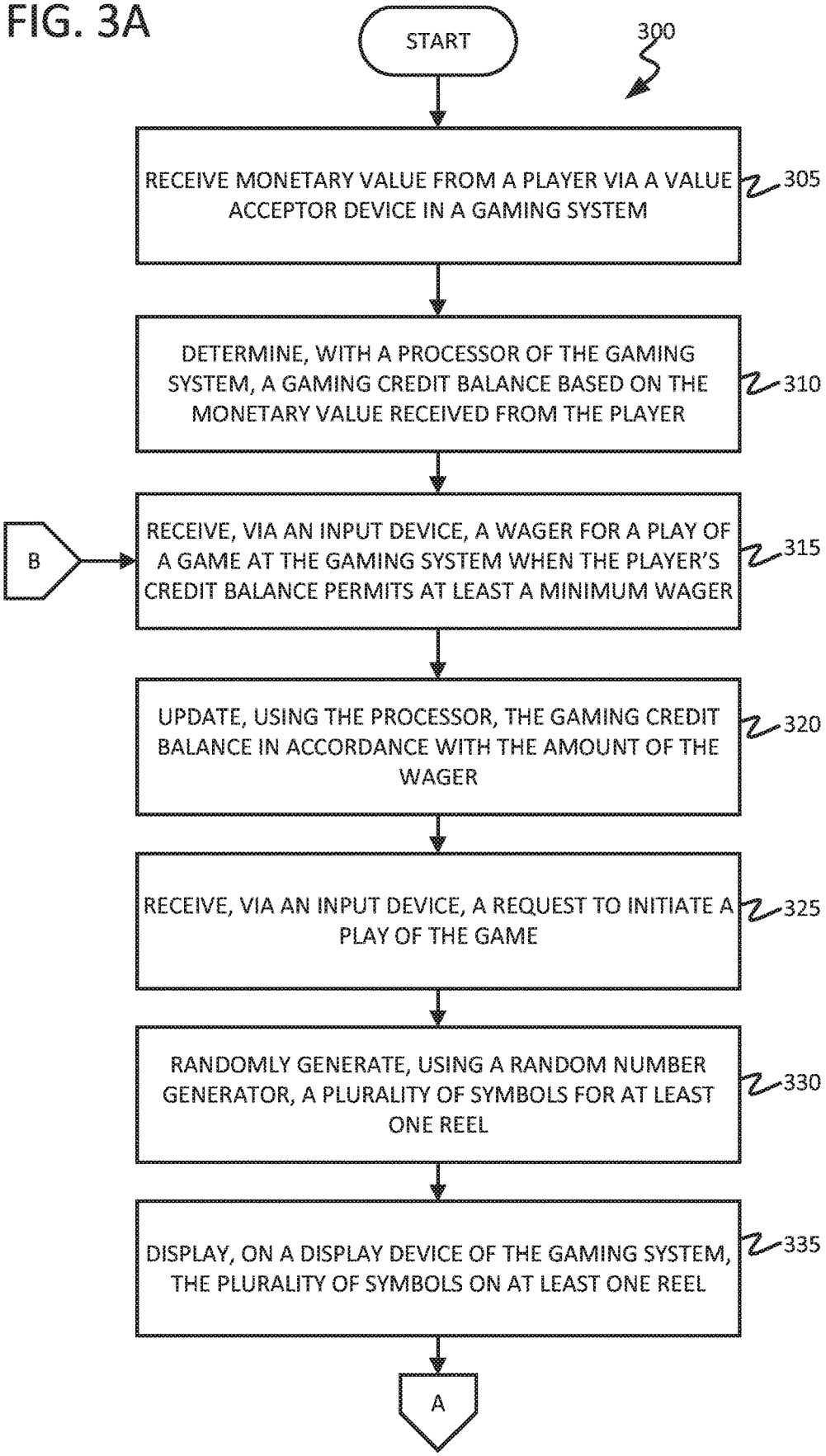
FIG. 3A shows a process flow diagram illustrating an example method of operating the gaming system that stores symbols in accordance with aspects of the present disclosure.
Figure 3B:
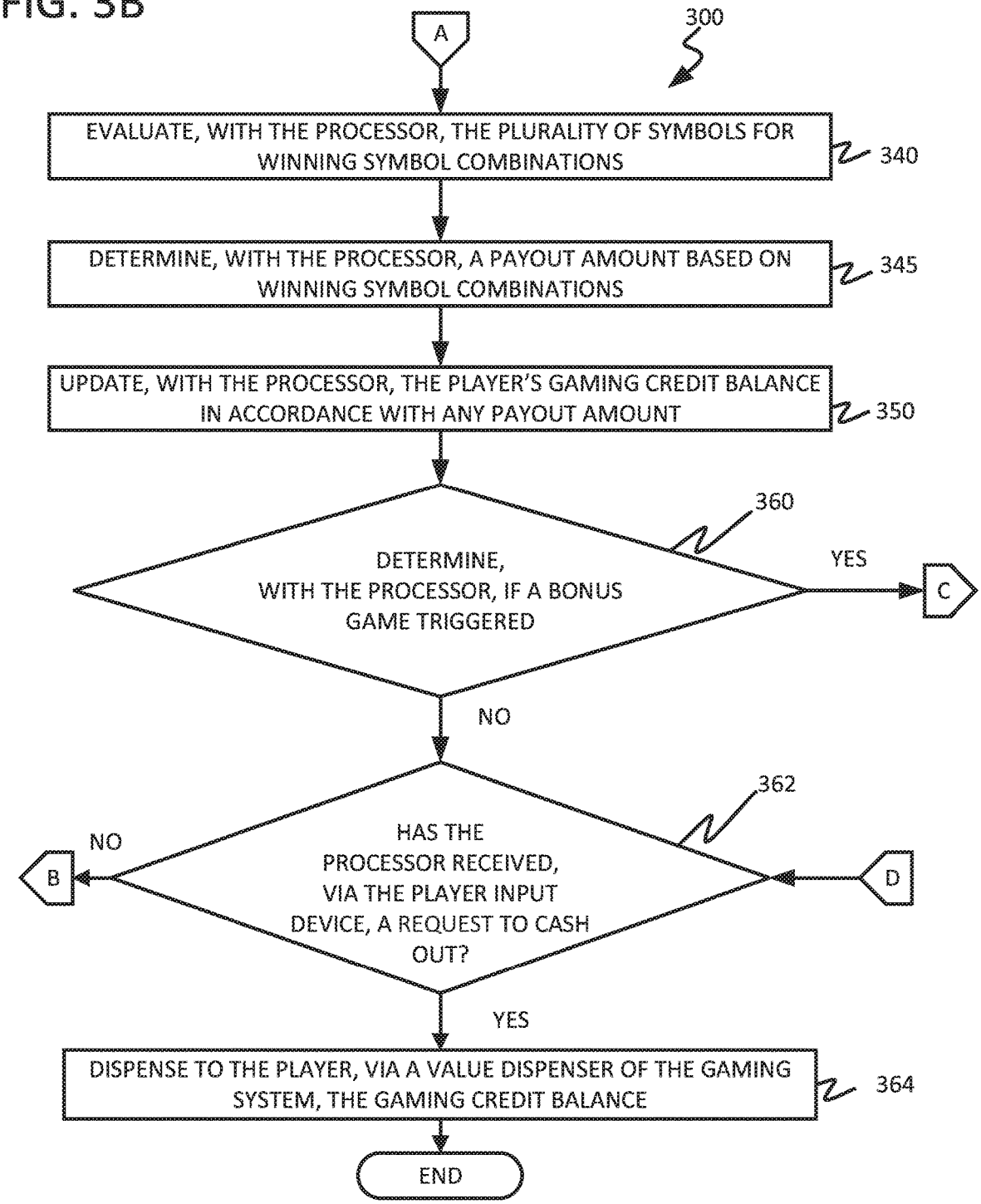
FIG. 3B shows a process flow diagram illustrating an example method of operating the gaming system that stores symbols in accordance with aspects of the present disclosure.
Figure 3C:
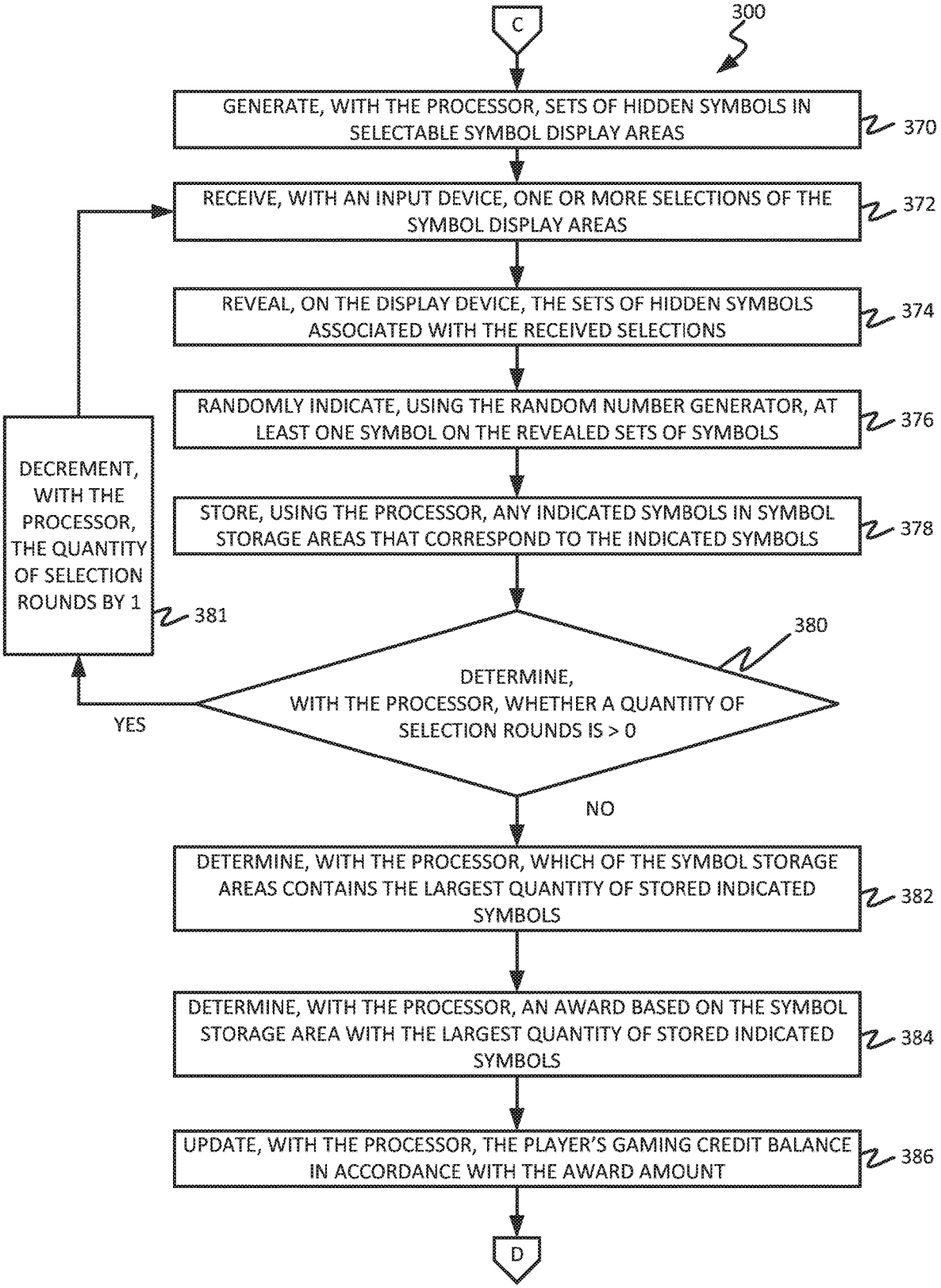
FIG. 3C shows a process flow diagram illustrating an example method of operating the gaming system that stores symbols in accordance with aspects of the present disclosure.

The flowcharts in FIGS. 3A, 3B, and 3C illustrate functionality and operation of possible implementations of systems, devices, methods, and computer program products according to various implementations of the present disclosure. Each block in the flow diagrams of FIGS. 3A, 3B, and 3C can represent a module, segment, or portion of program instructions, which includes one or more computer executable instructions for implementing the illustrated functions and operations. In some alternative implementations, the functions and/or operations illustrated in a particular block of the flow diagram can occur out of the order shown in FIGS. 3A, 3B, and 3C. For example, two blocks shown in succession can be executed substantially concurrently, or the blocks can sometimes be executed in the reverse order, depending upon the functionality involved. It will also be noted that each block of the flow diagram and combinations of blocks in the block diagram can be implemented by special purpose hardware-based systems that perform the specified functions or acts, or combinations of special purpose hardware and computer instructions. In some implementations, flowchart can include more blocks or fewer blocks.

FIGS. 3A, 3B, and 3C show a process flowchart illustrating an example of operation 300 of operating the gaming system (e.g., gaming system 100) providing symbol conversions based on stacked symbols in accordance with aspects of the present disclosure. FIGS. 3A and 3B describe parts of a base or primary game and FIG. 3C describes parts of a bonus game. However, it is understood that FIG. 3C may be integrated as part of a base game.

In some implementations, one or more processors (e.g., processor 202) of the gaming system are configured, via instructions (e.g., gaming module) stored in a memory device (e.g., memory 204 or a storage system), to perform the operation 300. In block 305, the gaming system receives monetary value via a value acceptor device (e.g., value acceptor 208). In block 310, the gaming system determines a credit balance based on the monetary value received from the player in block 305 at the value acceptor device. In block 315, the gaming system receives a wager for a play of a game from a player via an input device (e.g., player controller 212) using, e.g., the credit balance determined at block 310.

In some implementations, the gaming system allows the player to place a minimum wager, a maximum wager, or any suitable wager amount. In some implementations, the player's wager amount may determine the value of some of the available awards. Depending on the wager amount, the gaming system may also enable the player to select pay lines across displayed symbol positions (e.g., symbol display areas) on reels in a game in which to place wagers. Although in some implementations, the gaming system selects the wagered pay lines automatically based on the player's wager. Wagered pay lines may be referred to herein as active pay lines. In some implementations, the gaming system determines whether the credit balance determined at block 315 includes enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system. At block 320, the gaming system updates the credit balance determined at 310 in accordance with the amount wagered at 315.

At block 325, the gaming device receives a request to initiate a play of the game via the input device. For example, the player may press a spin button on the gaming system to start spinning slot machine reels of the gaming system (or randomly generating symbols using other methods discussed above for virtual reels) for the play of the game. In some implementations, a play of a game begins with a wager and activation of a game and the play of the game ends when the features of the base, bonus, or both have completed (depending on whether a bonus game is played). In another implementation, one play of a game comprises the processor executing blocks 315-386, and terminating at either block 360 or 361 depending on whether the gaming system activates a bonus game. In some implementations, block 362 and block 364 are not part of a play of a game. In alternative implementations, block 362 and block 364 are part of a play of a game.

It should be appreciated that reels or slot machine reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

At block 330, the gaming system randomly generates, using a random number generator (e.g., random number generator 214) game symbols for at least one reel of the gaming system from a first symbol set.

In some implementations, the gaming system may generate symbols for display on at least one reel. In some implementations, the gaming system may generate the symbols for display on a set of reels. In some such implementations, the reels are associated with respective sets of symbols. In some implementations, each reel is associated with one of the sets of symbols. At block 335, the gaming system causes a display device (e.g., first display device 120) to display the symbols generated at 330. For example, in a game using reels, the gaming system may display the generated symbols in visible symbol display areas of the individual reels.

Turning now to FIG. 3B and off page connector A, in some implementations as shown in block 340, the gaming system evaluates the generated symbols across active or wagered pay lines for winning symbol combinations. In some implementations, the gaming system evaluates the winning symbol combinations based on the pay lines wagered upon by a player. The gaming system may evaluate the player selected pay lines, gaming system assigned pay lines, or pay lines assigned as active in some other manner for the play of the game. In some implementations using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In some implementations, a pay table may indicate that as few as one symbol may be associated with a payout. Alternatively, two or more symbols may be used to form winning symbol combinations that result in a payout.

In some implementations, the gaming system may use other methods to determine winning symbol combinations in addition to or without pay lines. For example, the gaming system may evaluate generated and displayed symbols for scatter pay symbols, ways pays, etc. In some implementations with ways pays, the gaming system can determine a payout amount based on the gaming system generating one or more predetermined symbols on consecutive reels where the predetermined symbols are display on adjacent reels. In some implementations with way pays, the gaming system does not require pay lines or pay line selections.

In block 345, the gaming system determines, with the processor, a payout amount based on the evaluated winning symbol combinations across wagered pay lines. As illustrated in block 350, the gaming system may update, with the processor, the player's gaming credit balance in accordance with any award amount. As noted above, the blocks illustrated in FIGS. 3A-3C can be rearranged in any suitable order. As such, it should be appreciated that the gaming system may update the player's gaming credit balance at other suitable times.

In some implementations, as illustrated in block 360, the gaming system evaluates whether a bonus game is triggered. For example, the gaming system may include or be in communication with a bonus controller. The bonus controller may randomly determine, or determine based on a predetermined triggering event (quantity of games played), to trigger or activate a bonus game. The bonus controller can determine that the bonus game should be triggered using other suitable triggering events (e.g., how long a player has played the game, a time period since the last bonus game was triggered, etc.). In alternative implementations, the gaming system may evaluate the symbols for at least one symbols designated to trigger a bonus game.

If the gaming system determined that a bonus game is not triggered, in block 360, operation 300 moves to block 362. In some implementations, as indicated in block 362, the gaming system may receive a signal or a request to end game play or "cash out" via an input device of the gaming system (which would end the gaming session). In such a situation, the gaming system dispenses a value to the player, through a value dispenser, based on the player's gaming credit balance as illustrated in block 364 and operation 300 ends.

On the other hand, if the gaming system processor has not received a signal to end game play (e.g., the player continues a gaming session to play another play of the game) via the player input device, the process of operation 300 returns to block 315 via off page connector B. The gaming system may receive, via a player input device, a wager for another play of the game and continue operation 300 from block 315. However, in some implementations, the wager may not be accepted if the player has fewer credits than the player's selected wager amount, as shown in block 315.

Returning now to block 360, if the gaming system determined that a bonus game is triggered (e.g., based on a message from the bonus controller), operation 300 moves to block 370 in FIG. 3C via off page connector C. At block 370, the gaming system generates hidden sets of symbols in player selectable symbol display areas in some implementations. In some implementations, the gaming system displays a matrix of the symbol display areas with images covering and obscuring the hidden sets of symbols generated in the symbol display areas. In some implementations, the gaming system generates a hidden set of symbols for each symbol display area. In some implementations, one or more of the hidden sets of symbols comprises a wheel having multiple sections, where the sections are associated with symbols. In some implementations, each section of the wheel is associated with a different symbol.

In some implementations, the symbols in the sets of symbols can be any suitable symbol. In some implementations, the symbols in the sets of symbols can be associated with a theme. For example, the symbols in the sets of symbols can be images of past presidents and symbols for currency. In some implementations, the symbols in the sets of symbols can be fruits or face cards. In some implementations, the sets of symbols are homogenous, where each set comprises the same symbols. In some implementations, the sets of symbols are not homogenous, where one or more sets of symbols comprises different symbols.

In some implementations, as shown in block 372, the gaming system may receive one or more selections of the symbol display areas based on an input device. In some implementations, the player selects the symbol display areas with an input device, such as a touch screen interface. In some implementations, the gaming system may randomly make one or more of the selections of symbol display areas. In some implementations, the selection can be a combination of player selections and processor selections. In some implementations, the quantity of available selections is predetermined. For example, the quantity of available selections may be three selections. It should be appreciated that the gaming system can provide the player with any suitable quantity of selections.

In some implementations, as shown in block 372, the gaming system reveals the hidden sets of symbols (e.g., now revealed sets of symbols) associated with the received selections of symbol display areas.

In some implementations, the gaming system does not generate and display the hidden sets of symbols until the gaming system receives selections of the symbol display areas. That is, in some implementations of block 370, the gaming system may generate and display selectable symbol display areas, but not generate hidden sets of symbols until a later time (e.g., when the gaming system requires hidden sets of symbols to reveal). For example, in some implementations of the game, a player may not have an opportunity to select all available symbol display areas. Thus, if the gaming system generates hidden sets of symbols on an as needed basis, this enables the gaming system to generate fewer hidden sets of symbols for a play of the game. By generating fewer hidden sets of symbols, the efficiency of the gaming system can be improved because less memory and less processing power is used during the gaming system's execution for each round/play of the game. This efficiency also translates into faster game play because less time is used to complete the game's evaluation. When such efficiency improvements are made and applied to the hundreds and thousands of game evaluations that are made on a casino floor for the disclosed gaming system, the new gaming system will provide casino game operators sizable gains in machine efficiency, which is a technological improvement.

In some implementations, at shown in block 376, the gaming system randomly indicates, using an RNG, at least one symbol in the revealed sets of symbols. In some implementations, the gaming system randomly indicates a symbol for each of the revealed sets of symbols. In some implementations having a wheel with multiple sections as a revealed set of symbols, the wheel can be associated with an indicator. In some such implementations, the gaming system displays the wheel rotating around a central axis and stopping with the indicator identifying at least one symbol.

In some implementations, the gaming system includes one or more symbol storage areas for indicated symbols. In some implementations, as shown in block 378, the gaming system stores any indicated symbols in symbol storage areas that correspond to the indicated symbols. For example, if one indicated symbol is Grape symbol, the gaming system stores the Grape symbol in a symbol storage area for Grape symbols. If another indicated symbol is a Cherry symbol, the gaming system stores the Cherry symbol in a symbol storage area for Cherry symbols. In some implementations, different symbol storage areas are associated with different awards. In some implementations the awards are monetary awards; provided however, the awards can be any suitable awards including non-monetary awards. In some implementations, the awards are different progressive awards. The progressive award can be formed by collecting portions of wagers made at the gaming system and contributing such collected portions of the wagers to one or more progressive awards. The gaming system may collect any suitable portion of a wager for the one or more progressive awards. The gaming system may further divide any suitable portion of the collected portion of the wager to add to the different progressive awards corresponding to the different symbol storage areas. In some implementations, the player wins award associated with the symbol storage area that collected the largest quantity of indicated symbols among the other symbol storage areas.

In some implementations, at shown in block 380, the gaming system may determine whether a quantity of selection rounds is greater than a predetermined number. In some implementations, a selection round includes blocks 372-378; however a selection round may include more or fewer blocks. In some implementations, the gaming system provides the player a predetermined quantity of selection rounds upon entering the bonus game. For example, the gaming system may provide the player with three selection rounds for the bonus game. In some implementations, the predetermined quantity is one. However, the predetermined number can be any suitable number. While not shown, in some implementations, if the gaming system indicated certain symbols from the sets of revealed symbols, the gaming system may increase the quantity of selection rounds available to the player.

In some implementations, if the gaming system determines that the quantity of selection rounds is greater than zero, the gaming system may proceed to block 381. At block 381, the gaming system may decrement the quantity of selection rounds by one and return to block 372 to start a new selection round. As should be appreciated, in some implementations, the gaming system may repeat blocks 372-381 until the quantity of selection rounds is zero. In doing so, the gaming system may provide the player with multiple rounds of selections with one or more selections of symbol display areas the rounds. It should be appreciated that in some implementations, the gaming system may provide the player with one selection round with one or more selections.

Returning to block 380, in some implementations, if the gaming system determines that the quantity of selection rounds is zero the gaming system may proceed to block 382. In some implementations, the gaming system determines which of the different symbol storage areas contains the largest quantity of stored indicated symbols (e.g., a winning symbol storage area), as shown in block 382. At block 384, the gaming system determines an award based on the symbol storage area with the largest quantity of symbols. In some implementations, the symbol storage areas are associated with awards at the outset of a play of a game and the gaming system provides the player with the award associated with the winning symbol storage area. In some implementations, the awards are determined at the time the gaming system determines a winning symbol storage area. In some alternative implementations, the awards can be randomly determined at the outset of a play of the game, when the bonus controller triggered the bonus game, or at some other suitable time before or during the game.

In some implementations, the outcome of the bonus game is predetermined. For example, the gaming system may randomly determine which of the available awards the player will win at some time before or during a play of the game or a play of the bonus game. In some implementations, when the gaming system outcome of the game is so determined, the gaming system may still enable the player to make selections of sets of symbols in one or more rounds of selections, and indicated and store symbols during the bonus game. However, in a determined outcome in some implementations, the player's selections and stored symbols will result in the already determined outcome (e.g., the gaming system will provide one of the different awards that were already selected for the determined outcome).

At block 386, the gaming system may update the player's gaming credit balance in accordance with the award amount and operation 300 returns to block 362 in FIG. 3B via off page connector D.

In some implementations, as indicated in block 362, the gaming system may receive a signal to end game play or "cash out" via an input device of the gaming system (which would end the gaming session). In such a situation, the gaming system dispenses a value to the player, through a value dispenser, based on the player's gaming credit balance as illustrated in block 364 and operation 300 ends.

On the other hand, if the gaming system processor has not received a signal to end game play (e.g., the player continues a gaming session to play another play of the game) via the player input device, the process of operation 300 returns to block 315, as indicated by off-page connector B. The gaming system may receive, via a player input device, a wager for another play of the game and continue operation 300 from block 315. However, in some implementations, the wager may not be accepted if the player has fewer credits than the player's selected wager amount, as shown in block 315.

FIGS. 4A-4E show screen shots of one or more gaming system displays illustrating an example of a base and bonus game in accordance with aspects of the present disclosure. More specifically, FIGS. 4A-4E illustrate screen shots of one implementation of a gaming system that includes collecting symbols and determining an award based on the collected symbols.

Figure 4A:
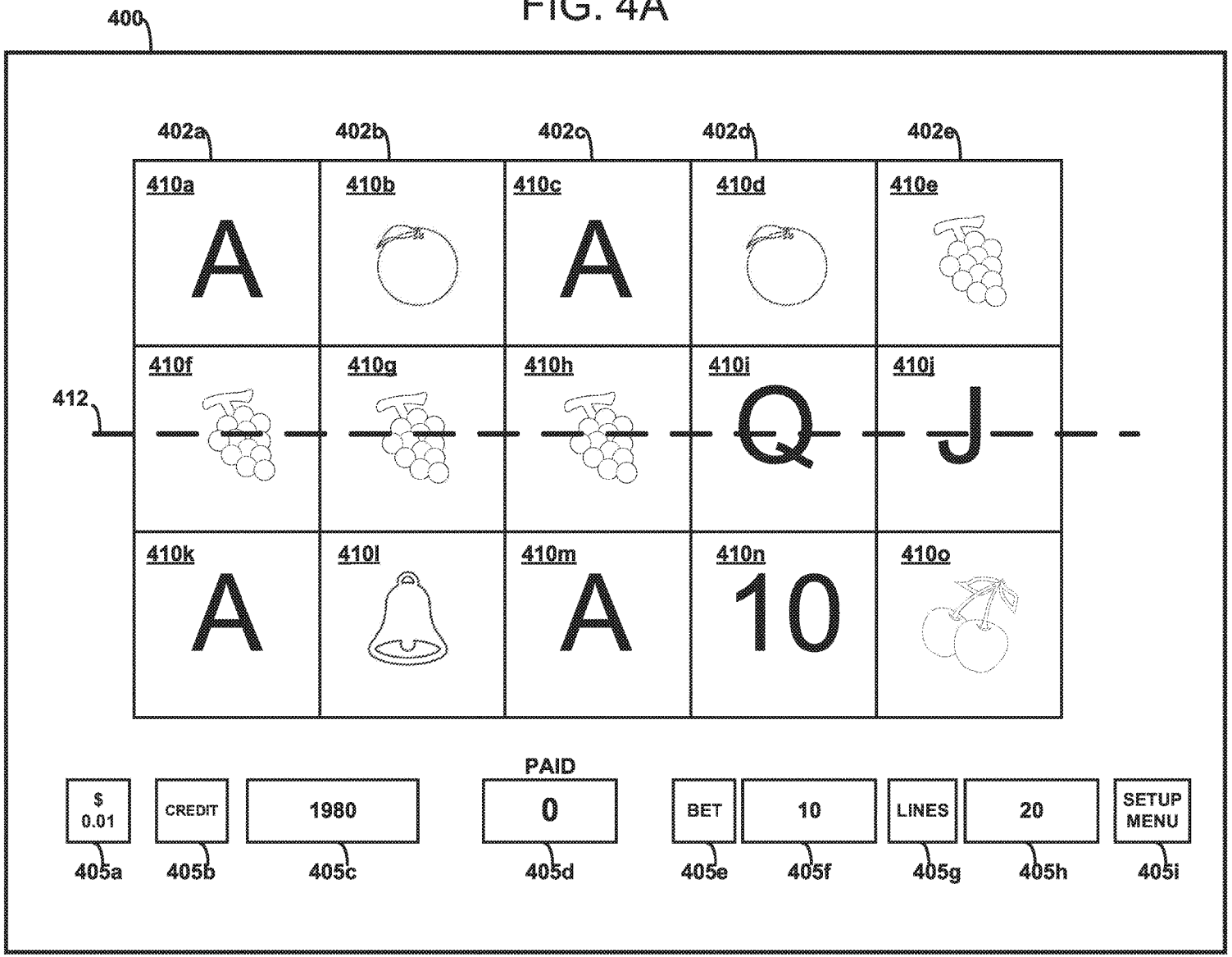
FIG. 4A shows a picture of a gaming system display illustrating an example symbol storage system in accordance with aspects of the present disclosure.

FIG. 4A illustrates one implementation of a game screen 400 that the gaming system 100 may display on a display device of the gaming system. In some implementations, game screen 400 may be displayed on first display 122 of gaming system 100 illustrated in FIG. 1. However, any other suitable display may be used. The game screen 400 displays a set of a virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game screen 400 is merely representative and may have more or fewer game elements (e.g., reels, symbol display areas, symbols, images, etc.) shown in the game screen 400. It should also be appreciated that other games may be used for the primary or base game.

In some implementations, the reels 402*a*-402*e* are each respectively associated with a set of symbols or a symbol set, where each set of symbols includes a number of symbols. The sets of symbols can be associated with the same or different symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols.

In some implementations, at least one predetermined symbol is a triggering symbol for a bonus game. However, in some implementations, a bonus game is triggered in alternative ways. In one such alternative implementation, a bonus game can be triggered by a bonus controller in communication with the gaming system. In some implementations, the bonus controller randomly generates and outputs a bonus game triggering signal that the gaming system uses to trigger a bonus game. In some implementations, the bonus controller outputs a bonus game triggering signal based on one or more different statistics, such as how much a player has wagered, how long the player has played games on the gaming system, etc. In some implementations, at least one triggering symbol must be generated on the reels during a play of a game to trigger the bonus game. In some implementations, multiple triggering symbols must be generated on the reels during a play of a game to trigger the bonus game. In some implementations, any one of the symbols in the symbol sets can be designated as the predetermined triggering symbol. The triggering symbol may be associated with one function (e.g., triggering a bonus game), but may alternatively be associated with a plurality of different game functions. The triggering symbol may be a scatter symbol in some implementations.

Returning to FIG. 4A, the game screen 400 depicts a plurality of symbol display areas (also referred to herein as symbol display positions) 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some implementations. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In some implementations, the plurality of symbol display areas that provide the appearance of five game reels may be arranged in a manner that visibly shows three symbol positions of each of the five game reels. For example, the symbol display areas 410*a*-410*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the implementation of FIG. 4A thus creates a visible display area of the reels 402*a*-402*e* comprising three visible symbol positions for each reel. When viewed together, reels 402*a*-402*e* appear like a 3-row by 5-column reel array in game screen 400. In various implementations, the gaming system may be configured to include fewer reels or more reels. In some implementations, smaller or larger visible areas of the reels can be displayed. That is, the reels 402*a*-402*e* may show fewer or a larger number of visible symbol display areas. In some implementations, some symbol display areas can be hidden to hold generated symbols for use when the reels are nudged. While symbol display areas are illustrated with defined boxes, it should be appreciated that in some implementations, the defined boxes are not visible to the player. It should also be appreciated that in some implementations, the symbol display areas are other shapes or not defined shapes and may not be associated with reels.

Reels 402*a*-402*e* may display a plurality of symbols that the gaming system generates from the sets of symbols in their respective symbol display areas as illustrated in FIG. 4A. In some implementations, the individual reels may be shown spinning in one direction to simulate slot machine reels. However, it should be appreciated that the reels may be shown spinning in any suitable direction. The reels may also be shown spinning in different directions in some implementations. In some implementations, the gaming system does not depict reels or spinning symbols.

Game screen 400 also includes several information areas and buttons 405*a*-405*i*. These information areas and buttons 405*a*-405*i* are illustrated in a particular arrangement, but may be arranged in any suitable manner in different implementations. In some implementations, game screen 400 may include more or fewer display areas and buttons 405*a*-405*i* than illustrated. Information area 405*a* illustrates an example value of one credit for the game displayed in game screen 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming system 100. Information area 405*f* illustrates that the player has selected to wager 200 credits. Button 405*g* illustrates a software button that the player can select to determine how many pay lines to wager on. It should be appreciated that the functionality of button 405*g* may also be replicated or replaced with a hardware button on the gaming system 100. Information area 405*h* illustrates that the player selected to wager on 20 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on the play of the game. The gaming system may provide a visual indication of the player's credit balance to the player as discussed above in information area 405*c*.

To initiate the play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time. In some implementations, the gaming system may use other methods to determine winning symbol combinations in addition to or without pay lines. For example, the gaming system may evaluate generated and displayed symbols for scatter pay symbols, ways pays, etc. In some implementations with ways pays, the gaming system can determine a payout amount based on the gaming system generating one or more predetermined symbols on consecutive reels where the predetermined symbols are adjacent. In some implementations with way pays, the gaming system does not require pay line selections.

Upon receipt of the player's wager and activation of the game start button, the gaming system may show a display of spinning reels for each of the reels 402*a*-402*e* for the start of a play of the game. The spinning may appear to occur in a vertical top to bottom direction or in a vertical bottom to top direction (not shown), or in a combination of vertical directions (not shown). In some implementations, the gaming system randomly generates symbols from the associated sets of symbols for reels 402*a*-402*e*, respectively. As noted above, the gaming system may rely on random generation performed by a pseudo RNG, a true RNG, or hardware RNG specifically designed for gaming systems. In some implementations, the gaming system may also update the player's credit meter (information area 405*c*) to reflect the player's available credit balance. As shown in FIG. 4A, the player's credit meter (information area 405*c*) was decremented by 200 credits from 2180 to 1980 to reflect the 200 credit wager the player placed for the play of the game.

The gaming system displays the generated symbols in symbol display areas 410*a*-410*o* as illustrated in FIG. 4A. Symbols displayed on reels 402*a*-402*e* illustrate the randomly generated symbols from the symbol sets after the reels have stopped spinning. As illustrated in FIG. 4A, the gaming system randomly generated and displayed symbols in symbol display areas 410*a*-410*o* for reels 402*a*-402*e*.

As illustrated in FIG. 4A, the gaming system generated and displayed Ace symbols in symbol display areas 410*a*, 410*c*, 410*k*, and 410*m*; Orange symbols in symbol display areas 410*b* and 410*d*; Grape symbols in symbol display areas 410*e*, 410*f*, 410*g*, 410*h*; a Queen symbol in symbol display area 410*i*; a Bell symbol in symbol display area 410*l*; a Jack symbol in symbol display area 410*j*; a 10 symbol in symbol display area 410*n*; and a Cherry symbol in symbol display area 410*o* in the game screen 400. It should be appreciated that the displayed symbol combinations are merely for explanatory purposes and the gaming system may randomly generate any suitable combination of symbols based on defined symbol sets associated with the reels 402*a*-402*e*. In the implementation illustrated in FIG. 4A, the gaming system evaluated the generated symbol combinations for winning symbol combinations.

In some implementations, the gaming system may execute an evaluation of the generated symbols on reels 402*a*-402*e* for winning symbol combinations. As noted above, the player may have wagered on one or more pay lines (such as 20 pay lines shown in information area 405*h*). In some implementations, at least the active (wagered on pay lines) are evaluated for winning symbol combinations. Any suitable number of pay lines may be used to evaluate winning symbol combinations. The gaming system may provide an award associated with the winning symbol combination of three Grape symbols in accordance with a pay table (not shown) associated with the base game. The gaming system may also update the player's gaming credit balance (e.g., 405*d*) or do so at a later time.

As noted at block 360 of FIG. 3B, in some implementations, the gaming system may also determine whether a bonus game is triggered. In some implementations, the gaming system determines whether a bonus controller outputs a bonus game triggering signal. In some implementations, the bonus controller randomly generates and outputs a bonus game triggering signal that the gaming system uses to trigger a bonus game. In some implementations, the bonus controller outputs a bonus game triggering signal based on one or more different statistics, such as how much a player has wagered, how long the player has played games on the gaming system, etc. In alternative implementations, the gaming system may evaluate the displayed symbols for displayed symbol combinations that trigger a bonus game. In some implementations, at least one symbol from the symbol sets are designated as a triggering symbol. When the gaming system determines that a predetermined quantity of triggering symbols are generated, the gaming system may activate a bonus game.

In FIG. 4A, the gaming system activates a bonus game based on a bonus game triggering signal from a bonus controller. In some implementations, the gaming system may execute the play of the bonus game as discussed in corresponding FIG. 3C.

Figure 4B:
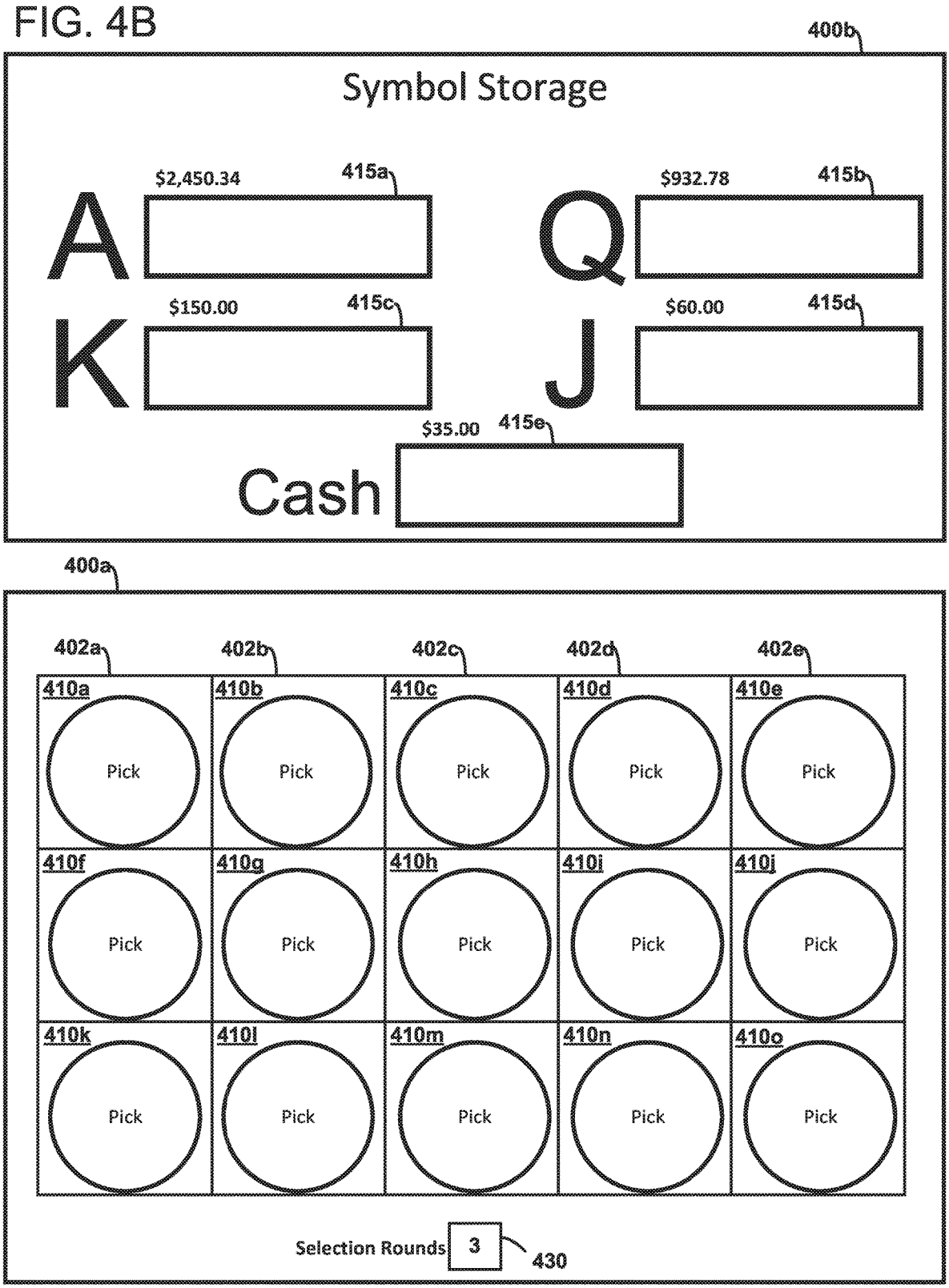
FIG. 4B shows a picture of a gaming system display illustrating an example symbol storage system in accordance with aspects of the present disclosure.

Turing to FIG. 4B, the gaming system displays a bonus game including a game screen 400*a* showing a matrix of selectable symbol display areas. The bonus game also includes a game screen 400*b* showing symbol storage areas for certain symbols. In some implementations, game screen 400*a* and game screen 400*b* can be displayed on the same display device. In some implementations, game screen 400*a* and game screen 400*b* can be displayed on different display devices.

In some implementations, the gaming system displays symbol display areas 410*a*-410*o* with images obscuring the other game elements in the symbol display areas in game screen 400*a*. In some implementations, the gaming system makes the symbol display areas and or the images selectable during the bonus game. In some implementations, the images inform the player that the images and/or symbol display areas that house the images are selectable. While the images shown in the symbol display areas of FIG. 4B are the same as the symbol display areas from FIG. 4A, it should be appreciated that in some implementations the symbol display areas used in the bonus game are unique for the bonus game and are different from the symbol display areas of the base game. The gaming system may include fewer or more symbol display areas for the bonus game. In some implementations, the gaming system may arrange the displayed symbol display areas in any other suitable manner other than the matrix illustrated in FIG. 4B.

In some implementations, the gaming system may generate hidden sets of symbols (sets of symbols hidden behind the images labeled "pick" in the symbol display areas) in the symbol display areas. The gaming system may generate the hidden sets of symbols at any time before or during the play of the game. As noted in connection with FIG. 3C, in some implementations, the gaming system generates the hidden sets of symbols on an as needed basis (e.g., when a symbol display area is selected and the gaming system reveals the set of symbols). In some implementations, the hidden sets of symbols are wheels, having one or more segments, where the segments are associated with at least one symbol. In other implementations, the hidden sets of symbols can be shown in other suitable forms. In some implementations, the symbols in the symbol sets can be any suitable symbol, such as described above in connection with FIG. 3C.

As also illustrated in FIG. 4B, the gaming system may display a counter 430 that shows the quantities of selection rounds the player has remaining. In some implementations, the gaming system provides the player with a predetermined quantity of selection rounds when a bonus game is triggered. For example, the predetermined quantity of selection rounds can be three selection rounds. In various implementations, the quantity of selection rounds is any suitable number. In some implementations, the quantity of selection rounds can vary based on a player's wager in a base game. In some implementations, the quantity of selection rounds can vary based on the gaming system randomly generating a number for the quantity of selection rounds. As the player uses selections rounds, the gaming system may decrement the display number of selection rounds. In some implementations, when the counter 430 reaches a predetermined number, the gaming system may terminate the bonus game. In some implementations, the predetermined number that prompts the gaming system to terminate the bonus game is zero. In alternative implementations, the gaming system may terminate the bonus game when the counter reaches a different predetermined number. In some implementations, when the player obtains a certain symbol during the bonus game, the gaming system may increment the counter 430 by one or more. In such implementations, the gaming system may reward the player with extra selection rounds for certain game events.

In some implementations, the gaming system provides the player with a predetermined quantity of selection attempts during a selection round. For example, the gaming system may provide the player with three selections of the selectable symbol display areas 410*a*-410*o*.

FIG. 4B further illustrates game screen 400*b* having different symbol storage areas for Ace symbols 415*a*, Queen symbols 415*b*, King symbols 415*c*, Jack symbols 415*d*, and Cash symbols 415*e*. In various implementations, the gaming system may include more or fewer symbol storage areas. The gaming system collects and stores symbols generated and/or indicated in game screen 400*a* that correspond to the different symbol storage areas (e.g., the symbol storage area 415*a* stores Ace symbols, symbol storage area 415*b* stores Queen symbols, etc.). The game screen 400*b* also shows the different symbol storage areas 415*a*-415*e* associated with different awards. In various implementations, the player wins an award associated with one of the different symbol storage areas 415*a*-415*e* based on one of the symbol storage areas storing the largest quantity of symbols among the other symbol storage areas. For example, if at the conclusion of the game the Ace symbol storage area stored more Ace symbols than the other symbol storage areas, then the player may win the award associated with the Ace symbol. In the illustrated implementation, the gaming system provides a monetary value if a player wins an award associated with one of the different symbol storage areas (e.g., the Ace symbol storage area is associate with an award of $2,450.34 dollars). It should be appreciated that in other implementations, the gaming system may provide credits or any other suitable type of award associated with one of the different symbol storage areas. In some implementations, the awards associated with the symbol storage areas are progressive awards. In some implementations, the progressive awards can be formed based portions of wagers (e.g., progressive award contributions) received at the gaming system executing plays of the game. In some implementations, the progressive awards can be formed based on wagers from multiple gaming systems in a local area network or a wide area network, or a combination of both. In some implementations, the progressive award contributions can be managed by a network accessible progressive controller.

Figure 4C:
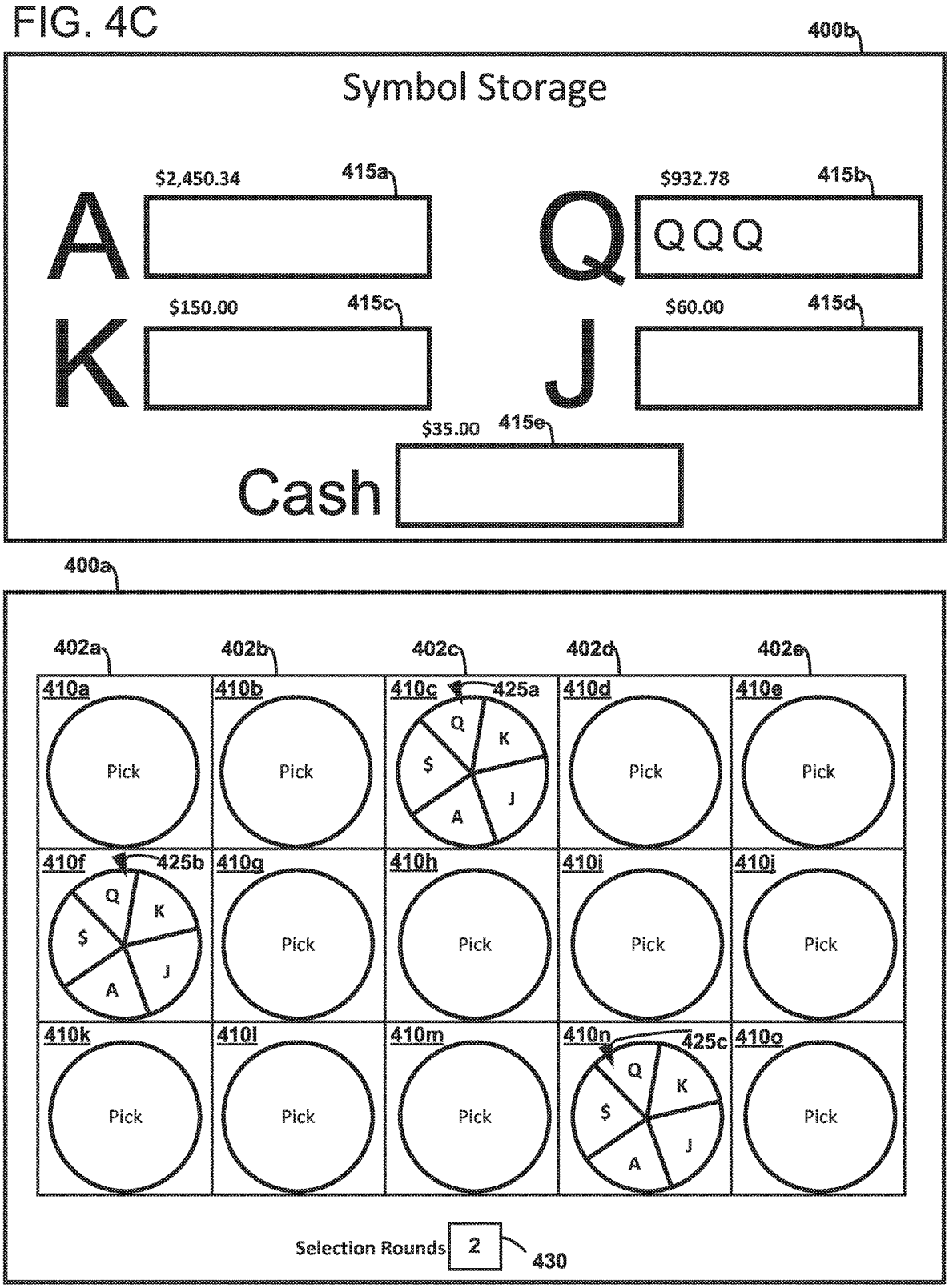
FIG. 4C shows a picture of a gaming system display illustrating an example symbol storage system in accordance with aspects of the present disclosure.

Turning to FIG. 4C, the gaming system enabled the player to make three selections of the symbol display areas. As noted above, the player may make the selections using a touch screen interface. In some implementations, the player may alternatively or in addition to the touch screen interface, make selections using one or more hardware buttons on a button deck. It should be appreciated that gaming system may enable the player to make selections in any suitable manner. In some implementations, the gaming system may automatically provide one or more of the selections to the player.

As illustrated in FIG. 4C, the player selected symbol display areas 410*c*, 410*f*, and 410*n* in game screen 400*a*. In accordance with the player selections, the gaming system revealed the previously hidden symbol sets. As also illustrated in FIG. 4C, the gaming system displayed the revealed symbol sets as wheels with segments. In some implementations, as illustrate in FIG. 4C, the wheels have five segments. In various implementations, the wheel can have any suitable number of segments. In some implementations, the segments of the wheel can be associated with one or more symbols (e.g., symbols of the hidden symbol sets). In some implementations, the wheels can include more symbols or fewer symbols. For the bonus game illustrated in FIGS. 4C-4E, the wheels include five symbols (e.g., an Ace symbol, a King symbol, a Queen symbol, a Jack symbol, and a Dollar Sign symbol). In some implementations, the symbols can include award values, multipliers, game terminators, etc. It should be appreciated that in various implementations, the symbols can be any suitable symbols.

In some implementations, as illustrated in FIG. 4C, the revealed wheels may include one or more symbol indicators. For example, the wheel in symbol display area 410*c* includes indicator 425*a*. The wheel in symbol display area 410*f* includes indicator 425*b*, and the wheel in symbol display area 410*n* includes indicator 425*c*. In some implementations, the indicators indicate a winning symbol for the selection round. In some implementations, the indicators are index pointers. In some implementations, the indicators can be other suitable indicators such as highlighting a segment of a wheel, changing the color of a wheel segment, etc.

In the illustrated FIG. 4C, in some implementations, the gaming system randomly selects (e.g., using an RNG) one of the symbols from each of the revealed wheels and indicates the selection with indicators 425*a*-425*c*. As illustrated, the indicator 425*a* for the wheel in symbol display area 410*c* indicates the Queen symbol. The indicator 425*b* for the wheel in symbol display area 410*f* also indicates the Queen symbol. Likewise, the indicator 425*c* for the wheel in symbol display area 410*n* indicates the Queen symbol. In some implementations, as part of the gaming system randomly selecting the symbols on the wheel, the gaming system may rotate the revealed wheels. In some implementations, the revealed wheels are rotated in unison to reveal the indicated symbols for the respective wheels. In some implementations, the revealed wheels are rotated at different times. In some implementations, the different revealed wheels are stopped at different times to show the player the indicated symbols at different times to heighten the anticipation.

In some implementations, when the gaming system includes a plurality of revealed wheels that are rotated in unison to reveal the indicated symbols for the respective revealed wheels, the resulting gaming system can be operated more efficiently than games with one wheel. For example, gaming systems using a single wheel to provide more than one indicated symbol must spin the one wheel in sequential order for each of the indicated symbols. However, by operating a plurality of revealed wheels concurrently during a play of a game, implementations of gaming systems in accordance with the present disclosure can complete at least some of the plays of the game more quickly than systems that use only one wheel to serially indicate multiple symbols. For example, in a gaming system with three revealed wheels that are rotated in unison to reveal three indicated symbols for the respective three revealed wheels, the gaming system can indicate three symbols in the time that it takes a gaming system with a single wheel to indicate three symbols. Thus, in some implementations, when the gaming system includes a plurality of revealed wheels that are rotated concurrently (e.g., substantially simultaneously or in unison) to reveal the indicated symbols for the respective wheels, such a gaming system can increase the usage rate (e.g., duty cycle) of the gaming system by allowing more games to be executed in a given time period (e.g., games per hour) than a gaming system that relies on a single wheel. The increased usage rate improves the efficiency of a gaming system because it translates into faster game play because less time is used to complete the game's evaluation.

In some implementations, as illustrated in FIG. 4C, after the symbols are indicated on the wheels, the gaming system collects these indicated symbols and stores the indicated symbols in a corresponding symbol storage area. In FIG. 4C, the gaming system displays a corresponding symbol storage area for the symbols on the different wheel segments. As illustrated in FIG. 4C, Queen symbols were indicated for the three revealed wheels. Accordingly, the gaming system collected the three Queen symbols and stored these symbols in the symbol storage area 415*b*, corresponding to the Queen symbol. In some implementations, the symbol storage areas may also include a counter. While the symbols in the wheel symbol sets all correspond to symbol storage areas, in some implementations, the symbol sets may include more symbols than symbol storage areas. That is, in some implementations, the gaming system cannot collect an indicated symbol where there is no corresponding symbol storage area (or counter for an indicated symbol).

As also shown in FIG. 4C, the gaming system decremented the counter 430 to indicate that two selection rounds remain.

Figure 4D:
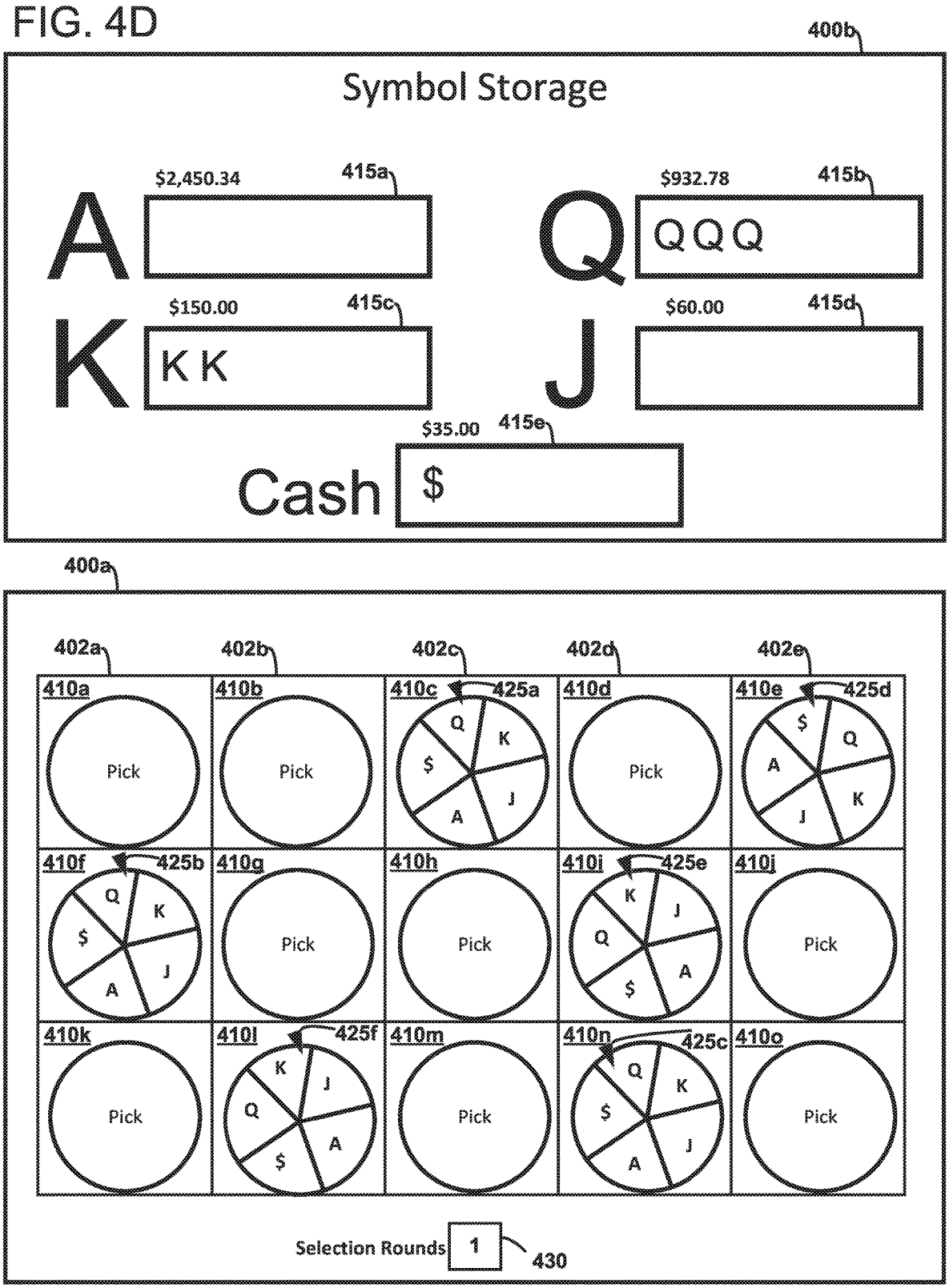
FIG. 4D shows a picture of a gaming system display illustrating an example symbol storage system in accordance with aspects of the present disclosure.

Turning to FIG. 4D, the gaming system enabled the player to make three additional selections of the symbol display areas for a second selection round. In some implementations, the revealed wheels associated with prior selections from the prior selection rounds remain displayed as shown in FIG. 4D. In some implementations, once revealed, the wheels remain revealed throughout the play of the game. In alternative implementations, after a round is complete, the gaming system may remove the revealed wheels. The prior selected symbol display areas may become selectable again in some implementations. In some implementations, if the symbol display areas become selectable again, the gaming system may randomly generate a new set of symbols for display in the wheel. The new set of symbols may include the same or different symbols as were previously displayed.

As illustrated in FIG. 4D, the player selected symbol display areas 410*e*, 410*i*, and 410*l* in game screen 400*a*. In accordance with the player selections, the gaming system revealed the previously hidden wheels for these symbol display areas. As illustrated in FIG. 4D, the revealed wheels may include symbol indicators. For example, the wheel in symbol display area 410*e* includes indicator 425*d*. The wheel in symbol display area 410*i* includes indicator 425*e*, and the wheel in symbol display area 410*l* includes indicator 425*f*.

As illustrated in FIG. 4D, in some implementations, the gaming system randomly selects (e.g., using an RNG) one of the symbols from each of the revealed wheels and indicates the selection with indicators 425*d*-425*f*. As illustrated in FIG. 4D, the indicator 425*d* for the wheel in symbol display area 410*e* indicates the Dollar Sign symbol. The indicator 425*e* for the wheel in symbol display area 410*i* indicates the King symbol. Likewise, the indicator 425*f* for the wheel in symbol display area 410*l* indicates the King symbol. In some implementations, as part of the gaming system randomly selecting the symbols on the wheel, the gaming system may rotate the revealed wheels. In some implementations, the revealed wheels are rotated in unison to reveal the indicated symbols for the respective wheels. In some implementations, the revealed wheels are rotated at different times. In some implementations, the different revealed wheels are stopped at different times to show the player the indicated symbols at different times to heighten the anticipation.

In some implementations, as illustrated in FIG. 4D, after the symbols are indicated on the wheels, the gaming system collects these indicated symbols and stores the indicated symbols in a corresponding symbol storage area. In FIG. 4D, the gaming system displays a corresponding symbol storage area for the symbols on the different wheel segments. As illustrated in FIG. 4D, the gaming system indicated King symbols for the two revealed wheels and a Dollar Sign symbol for one of the revealed wheels. Accordingly, the gaming system collected the two King symbols and stored these symbols in the symbol storage area 415*c*, corresponding to the King symbol. The gaming system also collected the Dollar Sign symbol and stored this symbol in the symbol storage area 415*e*, corresponding to the Dollar Sign symbol. In some implementations, the symbol storage areas may also include a counter that increments as indicated symbols are stored in the respective symbol storage areas.

As also shown in FIG. 4D, the gaming system decremented the counter 430 to indicate that one selection round remains. In some implementations, the gaming system may increase the quantity of available selection rounds by one or more if the gaming system indicated certain predetermined symbols. For example, the gaming system may be configured to increase the quantity of available selection rounds by one if the gaming system indicated a Dollar Sign symbol. In doing so, the gaming system may encourage a player to root for obtaining a lower value symbol in the hopes of obtaining additional selection opportunities to collect and store higher value symbols. It should be appreciated that in alternative implementations, the gaming system may increase the quantity of available selection rounds based on other predetermined symbols. In the illustrated implementation of FIG. 4D, the gaming system does not increase the quantity of selection rounds based on any symbols.

Figure 4E:
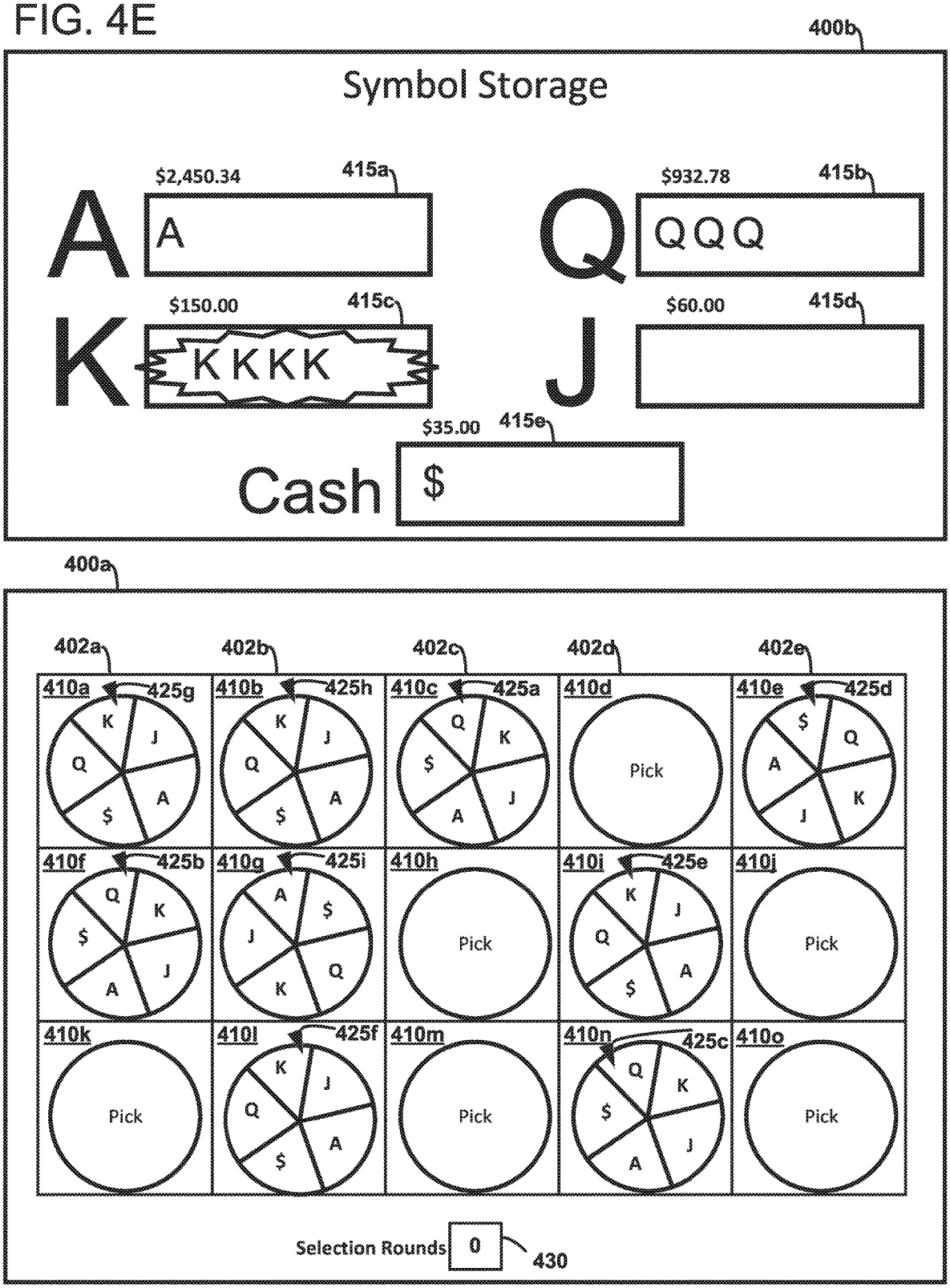
FIG. 4E shows a picture of a gaming system display illustrating an example symbol storage system in accordance with aspects of the present disclosure.

Turning to FIG. 4E, the gaming system enabled the player to make three additional selections of the symbol display areas for a third selection round. As illustrated in FIG. 4E, the player selected symbol display areas 410*a*, 410*b*, and 410*g* in game screen 400*a*. In accordance with the player selections, the gaming system revealed the previously hidden wheels for these symbol display areas.

As illustrated in FIG. 4E, the revealed wheels may include symbol indicators. For example, the wheel in symbol display area 410*a* includes indicator 425*g*. The wheel in symbol display area 410*b* includes indicator 425*h*, and the wheel in symbol display area 410*g* includes indicator 425*i*.

As illustrated FIG. 4E, in some implementations, the gaming system randomly selects (e.g., using an RNG) one of the symbols from each of the revealed wheels and indicates the selection with indicators 425*g*-425*i*. As illustrated in FIG. 4E, the indicator 425*g* for the wheel in symbol display area 410*a* indicates the King symbol. The indicator 425*h* for the wheel in symbol display area 410*b* also indicates the King symbol. The indicator 425*i* for the wheel in symbol display area 410*g* indicates an Ace symbol. In some implementations, as part of the gaming system randomly selecting the symbols on the wheel, the gaming system may rotate the revealed wheels. In some implementations, the revealed wheels are rotated in unison to reveal the indicated symbols for the respective wheels. In some implementations, the revealed wheels are rotated at different times. In some implementations, the different revealed wheels are stopped at different times to show the player the indicated symbols at different times to heighten the anticipation.

In some implementations, as illustrated in FIG. 4E, after the symbols are indicated on the wheels, the gaming system collects these indicated symbols and stores the indicated symbols in a corresponding symbol storage area. In FIG. 4E, the gaming system displays a corresponding symbol storage area for the symbols on the different wheel segments. As illustrated in FIG. 4E, gaming system indicated King symbols for the two revealed wheels and an Ace symbol for one of the revealed wheels. Accordingly, the gaming system collected the two King symbols and stored these symbols in the symbol storage area 415*c*, corresponding to the King symbol. The gaming system also collected the Ace symbol and stored this symbol in the symbol storage area 415*a*, corresponding to the Ace symbol. In some implementations, the symbol storage areas may also include a counter that increments as indicated symbols are stored in the respective symbol storage areas.

As also shown in FIG. 4E, the gaming system decremented the counter 430 to indicate that zero selection round remains. In some implementations, when the selection rounds indicator reaches zero, the gaming system determines that no selection rounds remain. In some implementations, the gaming system evaluates the symbol storage areas in game screen 400*b* for stored indicated symbols. The gaming system may calculate the quantities of stored indicated symbols in the different symbol storage areas and determine which of the different symbol storage areas stored the largest quantity of indicated symbols. In some implementations, the gaming system determines an award based on the symbol storage area with the largest quantity of stored indicated symbols among the different symbol storage areas. As illustrated in FIG. 4E, the gaming system determines that the King symbol storage area stored more King symbols than the other symbol storage areas storing their respective symbols. The gaming system may highlight the winning symbol storage area for the player in any number of suitable ways. As is illustrated in FIG. 4E, the gaming system highlighted the four winning stored King symbols to alert the player that the player won the $150.00 award associated with the King symbols storage area. The gaming system may provide a further announcement one or more of the game screens that the player won the $150.00 award.

In some implementations, the gaming system may provide an award associated with a symbol storage area based on different criteria than a symbol storage area that stored the most number of symbols. For example, the gaming system may an award associated with a symbol storage area based on the criteria such as a symbol storage area that stored the fewest number of symbols, a symbol storage area that did not store any symbols, etc.

In some implementations, it is possible for one or more of the symbol storage areas to store an equal quantity of indicated symbols. In some implementations, when two or more symbol storage areas have an equal quantity of indicated symbols, the gaming system may determine the symbol storage area associated with the highest value award as the winning symbol storage area. In alternative implementations, the gaming system may determine that to provide the player with one or more awards associated with one or more of the symbol storage areas. In some implementations, where the player was given the opportunity to select all available symbol display areas and stored an equal quantity of symbols in all symbol storage areas, the gaming system may provide a grand award that includes all of the awards for all of the symbol storage areas.

Upon determining the award, the gaming system may update the player's gaming credit balance (not shown) in accordance with the calculated award amount for the bonus game. In some implementations, the play of the game ends because no further selection rounds remain.

The player may continue the gaming session (e.g., another consecutive play of the game) by executing another play of the game. That is, the player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

In some implementations, the bonus game can be paired with any suitable base game.

In some implementations, the bonus game can be configured as a tournament game played among two or more network linked gaming systems. For example, the players at different linked gaming systems may attempt to obtain a largest quantity of symbols in a particular symbol storage area among the network linked gaming systems. In some implementations, the networked gaming system with the largest quantity of symbols in a particular symbol storage area wins the award associated with the symbol storage area (e.g., a gaming system among networked gaming systems that obtained the largest quantity of King symbols may win an award associated with the King symbol storage area). In some implementations, the gaming systems may provide an award associated with a particular symbol storage area at one gaming system among a plurality of different gaming systems regardless of whether the symbol storage area at the one gaming system collected the largest quantity of symbols among different symbol storage areas at the one particular gaming system. For example, a gaming system among networked gaming systems that obtained the largest quantity of King symbols may win an award associated with the King symbol storage area even though the gaming system obtained more Queen symbols in the gaming system's symbol storage area than King symbols in the gaming system's symbol storage area. Other suitable alterations are possible with the gaming system operates in a tournament environment of network gaming systems.

As described above, gaming systems in accordance with aspects of the present disclosure provide a specialized computing device integrating non-generic hardware and software that improve upon the existing technology of human-computer interfaces by providing unconventional functionality for generating interactive displays and outputs. The features of the gaming system improve the operation of the gaming systems for their specialized purpose of providing entertainment by reducing player disappointment with game outcomes, by enhancing player enjoyment, and by increasing player engagement with discussed gaming systems. Additionally, the features of the gaming system described herein technically improve the operation of gaming systems for their specialized purpose by providing more efficient gaming systems in some implementations.

Based on the forgoing description, it should be appreciated that a gaming system and method collecting and storing symbols in different symbol storage areas for awards creates new and very exciting ways for a player to obtain improved winnings with a potential to earn frequent and greater awards. Such a potential to earn greater awards creates a greatly improved sense of anticipation for players.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." In addition, where features or aspects of the disclosure are described in terms of Markush groups, those skilled in the art will recognize that the disclosure is also thereby described in terms of any individual member or subgroup of members of the Markush group.

A number of implementations of the invention have been described. Various modifications may be made without departing from the spirit and scope of the invention. For example, various forms of the flows shown above may be used, with steps re-ordered, added, or removed. Accordingly, other implementations are within the scope of the following claims.

I claim:

1. A gaming system comprising:
a cabinet;
a processor;
a display device supported by the cabinet;
an input device supported by the cabinet;
a bill validator supported by the cabinet;
a value dispenser supported by the cabinet;
a memory device that stores a plurality of instructions which, when executed by the processor, cause the processor to:
establish a credit balance based on a monetary value received by the bill validator;
decrease the credit balance by a wager amount received via the input device;
randomly generate a plurality of wheels in a plurality of symbol display areas, wherein the plurality of wheels comprise a plurality of symbols, and wherein the plurality of wheels are hidden in the plurality of symbol display areas;
receive, via the input device, a selection of a symbol display area of the plurality of symbol display areas;
reveal a wheel hidden in the selected symbol display area;
randomly indicate one symbol of the plurality of symbols on the revealed wheel;
store the indicated symbol in a symbol storage area associated with the indicated symbol;
determine a quantity of remaining selection rounds of the symbol display areas;
determine an award associated with a quantity of stored indicated symbols in the symbol storage area when the quantity of remaining selection rounds is a predetermined quantity;
display, on the display device, the determined award associated with the quantity of stored indicated symbols;
increase the credit balance by the award; and
issue another monetary value from the value dispenser based on the credit balance upon receipt of a cash out request.

2. The gaming system of claim 1, further comprising a plurality of symbol storage areas, where the plurality of symbol storage areas correspond to different symbols of the plurality of symbols.

3. The gaming system of claim 2, wherein the plurality of symbol storage areas store the corresponding different symbols of the plurality of symbols.

4. The gaming system of claim 3, wherein the instructions further cause the processor to evaluate the plurality of symbol storage areas and determine the award based on one of the plurality of symbol storage areas that contains a largest quantity of stored indicated symbols among the plurality of symbol storage areas.

5. The gaming system of claim 2, wherein the plurality of symbol storage areas are associated with different progressive awards.

6. The gaming system of claim 1, wherein the determined award is a progressive award.

7. The gaming system of claim 1, wherein the processor further receives a plurality of selections of the plurality of symbol display areas to reveal a plurality of wheels; and
for each of the revealed plurality of wheels, randomly indicating one of the displayed plurality of symbols.

8. The gaming system of claim 7, wherein the instructions further cause the processor to rotate the revealed plurality of wheels before randomly indicating the displayed plurality of symbols on the revealed plurality of wheels.

9. The gaming system of claim 1, wherein when at least one further selection of symbol display areas can be received, the processor further:
receives at least one second selection of one of the plurality of symbol display areas;
reveals a second one of the plurality of wheels;
randomly indicates one of a plurality of symbols of the revealed second one of the plurality of wheels; and
store the indicated one of the plurality of symbols of the revealed second one of the plurality of wheels in a second symbol storage area associated with the randomly indicated one of the plurality of symbols of the revealed second one of the plurality of wheels;
evaluate the symbol storage area and the second symbol storage area for stored indicated symbols; and
determine an award associated with whichever of the symbol storage area and the second symbol storage includes a largest quantity of stored indicated symbols.

10. The gaming system of claim 1, wherein the processor increases a selection counter of symbol display areas where the indicated one of the plurality of symbols is a predetermined symbol.

11. The gaming system of claim 1, wherein prior to randomly generating the plurality of wheels in the plurality of symbol display areas, the processor executes a base game.

12. The gaming system of claim 1, wherein the randomly generating the plurality of wheels in the plurality of symbol display areas is part of a bonus game that is randomly triggered based on a bonus controller.

13. The gaming system of claim 1, further comprising a plurality of symbol storage areas, where the plurality of symbol storage areas are associated with different progressive awards.

14. The gaming system of claim 1, wherein revealed wheels of the plurality of wheels remain revealed during a play of the game.

15. A method of operating a gaming system, the method comprising:
receiving, by a monetary bill validator, a monetary value;
establishing, by a processor of the gaming system, a credit balance based at least in part on the received monetary value;
accepting, from a first input device in a housing of the gaming system, a wager amount;
decreasing, by the processor, the credit balance by the wager amount;
randomly generating a plurality of wheels in a plurality of symbol display areas on a display device, wherein the plurality of wheels comprise a plurality of symbols, and wherein the plurality of wheels are hidden;
receiving a selection of a symbol display area;
revealing a wheel hidden in the selected symbol display area;
randomly indicating one symbol of the plurality of symbols on the revealed wheel;
storing the indicated symbol in a symbol storage area associated with the indicated symbol;
determining a quantity of remaining selection rounds of symbol display areas;

determining an award associated with a quantity of stored indicated symbols in the symbol storage area when the remaining quantity of selection rounds is a predetermined quantity;

displaying, on the display device, the determined award associated with the quantity of stored indicated symbols;

increasing, by the processor, the credit balance by the determined award; and issuing another monetary value, by a value dispenser, based on the credit balance upon receipt of a cash out request via a second input device of the gaming system.

16. The method of operating the gaming system of claim 15, further comprising a plurality of symbol storage areas, where the plurality of symbol storage areas correspond to different symbols of the plurality of symbols.

17. The method of operating the gaming system of claim 16, wherein the plurality of symbol storage areas store the corresponding different symbols of the plurality of symbols.

18. The method of operating the gaming system of claim 17, further comprising evaluating, with the processor, the plurality of symbol storage areas and determining the award based on one of the plurality of symbol storage areas that contains a largest quantity of stored indicated symbols among the plurality of symbols storage areas.

19. The method of operating the gaming system of claim 18, wherein the plurality of symbol storage areas are associated with different progressive awards.

20. A non-transitory computer-readable storage medium having machine instructions stored therein, the instructions being executable by a processor to cause the processor to:

establish a credit balance based at least in part on a monetary value received by a bill validator of a gaming device;

place a wager following receipt of a wager input via a first input device;

decrease the credit balance by the wager;

randomly generate a plurality of symbol sets in a plurality of symbol display areas on a display device, wherein the plurality of symbol sets comprise a plurality of symbols, and wherein the plurality of symbol sets are hidden;

receive a selection of a symbol display area of the plurality of symbol display areas;

reveal a symbol set hidden in the selected symbol display area;

randomly indicate one symbol of the revealed symbol set;

store the indicated symbol in a symbol storage area associated with the indicated symbol;

reduce a quantity of remaining selection rounds of symbol display areas;

determine the quantity of remaining selection rounds of symbol display areas after the reduction;

determine an award associated with a quantity of stored indicated symbols in the symbol storage area when the quantity of remaining selection rounds is a predetermined quantity;

display, on the display device, the determined award associated with the quantity of stored indicated symbols;

increase the credit balance by the determined award; and issue another monetary value from a value dispenser based on the credit balance upon receipt of a cash out request via a second input device.

* * * * *